US005450184A

United States Patent [19]

Yanai et al.

[11] Patent Number: 5,450,184

[45] Date of Patent: Sep. 12, 1995

[54] CLEANING BLADE FOR ELECTROPHOTOGRAPHY, CLEANING DEVICE FOR ELECTROPHOTOGRAPHY, APPARATUS UNIT, ELECTROPHOTOGRAPHIC APPARATUS AND FACSIMILE APPARATUS

[75] Inventors: Noriyuki Yanai; Masahiro Watabe, both of Yokohama, Japan

[73] Assignee: Canon Kabushiki Kaisha, Tokyo, Japan

[21] Appl. No.: 139,882

[22] Filed: Oct. 22, 1993

Related U.S. Application Data

[63] Continuation of Ser. No. 710,772, Jun. 5, 1991, abandoned.

[30] Foreign Application Priority Data

Jun. 7, 1990 [JP] Japan ..... 2-150214
Feb. 8, 1991 [JP] Japan ..... 3-017642

[51] Int. Cl.[6] ..... G03G 21/00
[52] U.S. Cl. ..... 355/299; 15/256.5
[58] Field of Search ..... 355/296, 297, 299; 15/256.5, 256.51, 256.52, 250.36

[56] References Cited

U.S. PATENT DOCUMENTS

| | | | |
|---|---|---|---|
| 3,892,785 | 7/1975 | Billigmeier et al. | 260/404.5 |
| 3,936,183 | 2/1976 | Sadamatsu | 355/299 |
| 3,973,845 | 8/1976 | Lindblad et al. | 134/6 |
| 4,076,564 | 2/1978 | Fisher | 156/664 |
| 4,622,712 | 11/1986 | Sugita et al. | 15/250.36 |
| 4,818,123 | 4/1989 | Gu | 384/106 |
| 4,825,249 | 4/1989 | Oki et al. | 118/652 X |
| 4,833,058 | 5/1989 | Hirano et al. | 355/259 X |
| 4,908,661 | 3/1990 | Iwata et al. | 355/211 |
| 4,928,126 | 5/1990 | Asai | 346/140 R |
| 5,021,534 | 6/1991 | Kawasaki et al. | 528/60 |
| 5,038,181 | 8/1991 | Yoshida et al. | 355/299 |
| 5,080,976 | 1/1992 | Yanai et al. | 428/423.1 |
| 5,117,264 | 5/1992 | Frankel et al. | 355/229 |

FOREIGN PATENT DOCUMENTS

| | | |
|---|---|---|
| 0384354 | 8/1990 | European Pat. Off. . |
| 49-011704 | 2/1974 | Japan . |
| 57-064277 | 4/1982 | Japan . |
| 59-052273 | 2/1984 | Japan . |
| 59-052273 | 3/1984 | Japan . |
| 61-255375 | 11/1986 | Japan . |
| 62-102271 | 5/1987 | Japan . |

*Primary Examiner*—Leo P. Picard
*Assistant Examiner*—Christopher Horgan
*Attorney, Agent, or Firm*—Fitzpatrick, Cella, Harper & Scinto

[57] ABSTRACT

A cleaning blade for electrophotography has a blade body having a rubbery elasticity and a coating layer covering the surface of the blade body. The coating layer is composed of lubricating particles and a binder resin having a lubricability and a wear resistance. The blade body extends parallel to an axis of the latent image support.

95 Claims, 5 Drawing Sheets

CLEANING BLADE FOR ELECTROPHOTOGRAPHY, CLEANING DEVICE FOR ELECTROPHOTOGRAPHY, APPARATUS UNIT, ELECTROPHOTOGRAPHIC APPARATUS AND FACSIMILE APPARATUS

This application is a continuation of prior application Ser. No. 07/710,772 filed Jun. 5, 1991, now abandoned.

BACKGROUND OF THE INVENTION

1. Field of the Invention

This invention relates to a cleaning blade in pressing contact with the surface of an electrostatically charged latent image support and for removing toners remaining on the surface, the cleaning blade being used in an image-forming apparatus such as electrostatic copying machines, printers, and facsimile apparatuses and also in apparatuses using the cleaning blade.

2. Related Background Art

Electrophotographic apparatus for forming an image by transferring a toner image on the surface of an electrostatically charged latent image support to a transfer material includes, for example, copying machines, laser beam printers (LBP) and facsimile apparatuses.

The electrophotographic process will be explained below,

The surface of a photosensitive member as an electrostatically charged latent image support is negatively charged by a charging means and then subjected to image scanning by exposure to a laser beam as a latent image-forming means, thereby forming digital latent images on the surface of the photosensitive member, Then, the electrostatic latent images formed on the surface of the photosensitive member are developed with toners to form toner images, and the toner images are electrostatically transferred to a transfer material. The electrostatically transferred toner images on the transfer material are fixed by a fixer as a fixing means to form fixed images on the transfer material.

On the other hand, the toners remaining on the surface of the photosensitive member after the transfer step are removed by cleaning with a cleaning means having a cleaning blade. After the removal of toners by cleaning, the photosensitive member is discharged by erasing light exposure and then repeatedly used in the electrophotographic process starting with the charging step.

When the removal of toners from the photosensitive member by cleaning with a cleaning blade is incomplete, succeeding latent images are formed while the toners remain on the photosensitive member, and thus parts of the formed latent images drop off.

The cleaning blade is a plate-shaped molding product made mainly from a polyurethane elastomer and works to physically remove toners attached to the surface of a photosensitive member by cleaning through contact therewith. In that case, the blade must overcome the electrostatically attractive force of toners attracting the toners toward the surface of the photosensitive member to remove the toners from the surface of the photosensitive toner, and thus the blade must be pressed onto the surface of the photosensitive member with a large pressing force. That is, a large frictional force develops between the photosensitive member and the cleaning blade, and the cleaning blade is turned up and reversed, resulting in a failure in the rotary movement of the photosensitive member or in the cleaning. When the surface of the photosensitive member is soft, the surface is considerably scraped, resulting in poor images or a shortened life of the photosensitive member. Particularly at the initial period, coagulation takes place between the surface of the photosensitive member and the cleaning blade, because of the smooth surface of the photosensitive member, and thus the cleaning blade is more liable to turn up.

To solve these problems, various improvements have been so far proposed. Powder of fluorocarbon resins such as PTFE and PVDF is applied to the edge of a cleaning blade to prevent the initial turn-up of the cleaning blade. However, the powder of fluorocarbon resins is retained on the surface of the cleaning blade only through a weak electrostatic interaction, and thus is very likely to disengage from the surface of the cleaning blade during the working. When the photosensitive member is charged while the disengaged powder of fluorocarbon resins remains on the photosensitive member, the fluorocarbon resins are abnormally charged to retain an electrical memory on the photosensitive member, resulting in poor images.

When a charging system for bringing a roller-shaped charger into contact with the surface of a photosensitive member is used in place of a primary charger for conducting ordinary corona charging as a system for charging the photosensitive member, the powder of fluorocarbon resins disengaged from the cleaning blade is filled in the space between the photosensitive member and the contact-type charger, resulting in poor charging or the powder is deposited onto the contact-type charger, resulting in poor charging. Thus, there are problems such as the formation of poor images.

As an alternative, coating of the surface of the cleaning blade with polyamide resin such as nylon is proposed [Japanese Patent Application Kokai (Laid-Open) No. 59-52273], where the frictional coefficient can be lowered but is still not satisfactory, and since the surface of the photosensitive member is smooth particularly at the initial stage, coagulation with the surface of the cleaning blade takes place, making the blade turn up or the coating layer peel off or become defective. Furthermore, the surface of the electrostatically charged latent image support is sometimes scraped off during prolonged operation.

As another process, Japanese Patent Application Kokai (Laid-Open) No. 49-11704 (corresponding to U.S. Pat. No. 3,936,183) discloses a cleaning blade comprising a polyurethane sheet and a coating layer formed on the surface of the polyurethane sheet, the coating layer containing fine powder of inorganic lubricant material such as graphite fluoride or organic lubricant material such as polyvinylidene fluoride, using a resin material such as polyurethane, epoxy resin, phenol resin or alkyd resin as a binder for the coating layer. However, the resin material used as a binder for the coating layer is not better in both lubricability and wear resistance, and when the cleaning blade is used in an electrophotographic apparatus to clean the surface of the photosensitive member to remove the remaining toners therefrom, the binder resin is worn out and the fine lubricant powder drops off the coating layer, resulting in the incomplete removal of toners.

SUMMARY OF THE INVENTION

An object of the present invention is to provide a cleaning blade that solves the problems mentioned above and also to provide an apparatus using such a cleaning blade.

Another object of the present invention is to provide a cleaning blade capable of reducing the frictional resistance that developes during relative sliding with an electrostatically charged latent image support when brought into a pressing contact therewith, and also capable of maintaining the reduced frictional resistance during prolonged operation, and also to provide an apparatus using such a cleaning blade.

Another object of the present invention is to provide a cleaning blade capable of continuously removing toners remaining on the surface of an electrostatically charged latent image support surely therefrom by cleaning the support surface, and also to provide an apparatus using such a cleaning blade.

A further object of the present invention is to provide a cleaning blade capable of continuously providing good images with no or less scraping of the surface of an electrostatically charged latent image support, and also to provide an apparatus using such a cleaning blade.

A still further object of the present invention is to provide a cleaning blade for electrophotography, comprising a blade body having a rubbery elasticity and a coating layer covering the surface of the blade body, wherein the coating layer comprises lubricating particles and a binder resin having good lubricability and wear resistance.

A still further object of the present invention is to provide a cleaning blade for electrophotography, comprising a blade body having a rubbery elasticity and a coating layer covering the surface of the blade body, wherein the coating layer comprises lubricating particles and a binder resin and is formed at least on the surface at a blade body edge on the side in contact with an electrostatically charged latent image support and in parallel to the axial direction of the blade body, and the lubricating particles are directly exposed from the binder resin on the contact surface of the coating layer with the electrostatically charged latent image support.

A still further object of the present invention is to provide a cleaning device for electrophotography, comprising a cleaning blade for removing toners from the surface of an electrostatically charged latent image support, the cleaning blade comprising a blade body having a rubbery elasticity and a coating layer covering the surface of the blade body and being in an elastically pressing contact with the surface of the electrostatically charged latent image support, wherein the coating layer comprises lubricating particles and good binder resin having a lubricability and wear resistance.

A still further object of the present invention is to provide a cleaning device for electrophotography, comprising a cleaning blade for removing toners from the surface of an electrostatically charged latent image support, the cleaning blade comprising a blade body having a rubbery elasticity and a coating layer covering the surface of the blade body and being in an elastically pressing contact with the surface of the electrostatically charged latent image support, wherein the coating layer comprises lubricating particles and a binder resin and is formed at least on the surface at a blade body edge on the side in contact with an electrostatically charged latent image support and in parallel to the axial direction of the blade body, and the lubricating particles are directly exposed from the binder resin on the contact surface of the coating layer with the electrostatically charged latent image support.

A still further object of the present invention is to provide an apparatus unit comprising a single unit, (i) the single unit comprising an electrostatically charged latent image support for supporting electrostatically charged latent images, a charging means for charging the electrostatically charged latent image support, a developing means for developing the electrostatically charged latent images supported on the electrostatically charged latent image support, and a cleaning means comprising a cleaning blade in an elastically pressing contact with the surface of the electrostatically charged latent image support, at least one of the charging means and the developing means being integrally supported together with the electrostatically charged latent image support and the cleaning means, and (ii) the single unit being detachable from the apparatus body, wherein the cleaning blade comprises a blade body having a rubbery elasticity and a coating layer covering the surface of the blade body and said coating layer comprises lubricating particles and a binder resin lubricability and wear resistance.

A still further object of the present invention is to provide an apparatus unit comprising a single unit, (i) the single unit comprising an electrostatically charged latent image support for supporting electrostatically charged latent images, a charging means for charging the electrostatically charged latent image support, a developing means for developing the electrostatically charged latent images supported on the electrostatically charged latent image support, and a cleaning means comprising a cleaning blade in an elastically pressing contact with the surface of the electrostatically charged latent image support, at least one of the charging means and the developing means being integrally supported together with the electrostatically charged latent image support and the cleaning means, and (ii) the single unit being detachable from the apparatus body, wherein the cleaning blade comprises a blade body having a rubbery elasticity and a coating layer comprising lubricating particles and a binder resin, the coating layer is formed at least on the surface at a blade body edge on the side in contact with the electrostatically charged latent image support and in parallel to the axial direction of the blade body, and the lubricating particles are directly exposed from the binder resin on the contact surface of the coating layer with the electrostatically charged latent image support.

A still further object of the present invention is to provide an electrophotographic apparatus comprising an electrostatically charged latent image support for supporting electrostatically charged latent images, a charging means for charging the electrostatically charged latent image support, a latent image-forming means for forming electrostatically charged latent images on the electrostatically charged latent image support, a developing means for developing electrostatically charged latent images supported on the electrostatically charged latent image support, and a cleaning means comprising a cleaning blade in elastically pressing contact with the surface of the electrostatically charged latent image support, wherein the cleaning blade comprises a blade body having a rubbery elasticity and a coating layer covering the surface of the blade body and comprising lubricating particles and a binder resin having good lubricability and wear resistance.

A still further object of the present invention is to provide an electrophotographic apparatus comprising an electrostatically charged latent image support for supporting electrostatically charged latent images, a charging means for charging the electrostatically charged latent image support, a latent image-forming means for forming electrostatically charged latent images on the electrostatically charged latent image support, a developing means for developing electrostatically charged latent images supported on the electrostatically charged latent image support, and a cleaning means comprising a cleaning blade in elastically pressing contact with the surface of the electrostatically charged latent image support, wherein the cleaning blade comprises a blade body having a rubbery elasticity and a coating layer comprising lubricating particles and a binder resin, and the coating layer is formed at least on the surface at a blade body edge on the side in contact with the electrostatically charged latent image support and in parallel to the axial direction of the blade body, and the lubricating particles are directly exposed from the binder resin on the contact surface of the coating layer with the electrostatically charged latent image support.

A still further object of the present invention is to provide a facsimile apparatus comprising an electrophotographic apparatus and a receiving means for receiving image information from a remote terminal, wherein the electrophotographic apparatus comprises an electrostatically charged latent image support for supporting electrostatically charged latent images, a charging means for charging the electrostatically charged latent image support, a latent image-forming means for forming electrostatically charged latent images on the electrostatically charged latent image support, a developing means for developing the electrostatically charged latent images supported on the electrostatically charged latent image support, and a cleaning means comprising a cleaning blade in elastically pressing contact with the surface of the electrostatically charged latent image support, and the cleaning blade comprises a blade body having a rubbery elasticity and a coating layer covering the surface of the blade body and comprising lubricating particles and a binder resin having good lubricability and wear resistance.

A still further object of the present invention is to provide a facsimile apparatus comprising an electrophotographic apparatus and a receiving means for receiving image information from a remote terminal, wherein the electrophotographic apparatus comprises an electrostatically charged latent image support for supporting electrostatically charged latent images, a charging means for charging the electrostatically charged latent image support, a latent image-forming means for forming electrostatically charged latent images on the electrostatically charged latent image support, a developing means for developing the electrostatically charged latent images supported on the electrostatically charged latent image support, and a cleaning means comprising a cleaning blade in elastically pressing contact with the surface of the electrostatically charged latent image support, the cleaning blade comprises a blade body having a rubbery elasticity and a coating layer comprising lubricating particles and a binder resin, and the coating layer is formed at least on the surface at a blade body edge on the side in contact with the electrostatically charged latent image support and in parallel to the axial direction of the blade body, and the lubricating particles are directly exposed from the binder resin on the contact surface of the coating layer with the electrostatically charged latent image support.

The present cleaning blade has a coating layer comprising lubricating particles and a binder resin having lubricability and wear resistance on the surface of a blade body having a rubbery elasticity, and thus the frictional coefficient can be largely reduced by both of the lubricating particles and the binder resin. That is, when the present cleaning blade is used in pressing contact with an electrostatically charged latent image support, the coating layer containing the lubricating particles on the surface of the blade body can contact the electrostatically charged latent image support to surely remove the toners remaining on the electrostatically charged latent image support and clean the support without turning-up of the cleaning blade. Since the lubricating particles are contained in the coating layer together with the binder resin, the lubricating particles are never disengaged from the coating layer and the cleaning blade can stably maintain a low frictional performance with no wear or less wear, because the binder resin has wear resistance.

Furthermore, in the present cleaning blade, the coating layer comprising lubricating particles and a binder resin is formed at least on the surface at the edge on the side of the blade body having a rubbery elasticity in contact with the electrostatically charged latent image support and in parallel to the axial direction of the blade body, and the lubricating particles are directly exposed from the binder resin on the contact surface of the coating layer with the electrostatically charged latent image support, and thus the frictional coefficient can be largely reduced owing to the lubricating particles directly exposed from the binder resin. That is, when the present cleaning blade is used in pressing contact with the electrostatically charged latent image support, the coating layer containing the lubricating particles formed on the surface of the blade body contacts the electrostatically charged latent image support to remove the toners remaining on the electrostatically charged latent image support and clean the support without turning-up of the cleaning blade. Since the lubricating particles are contained in the coating layer together with the binder resin, the cleaning blade can stably maintain a low frictional coefficient without any disengagement of the lubricating particles from the coating layer.

DETAILED DESCRIPTION OF THE PREFERRED EMBODIMENTS

Figure 1:
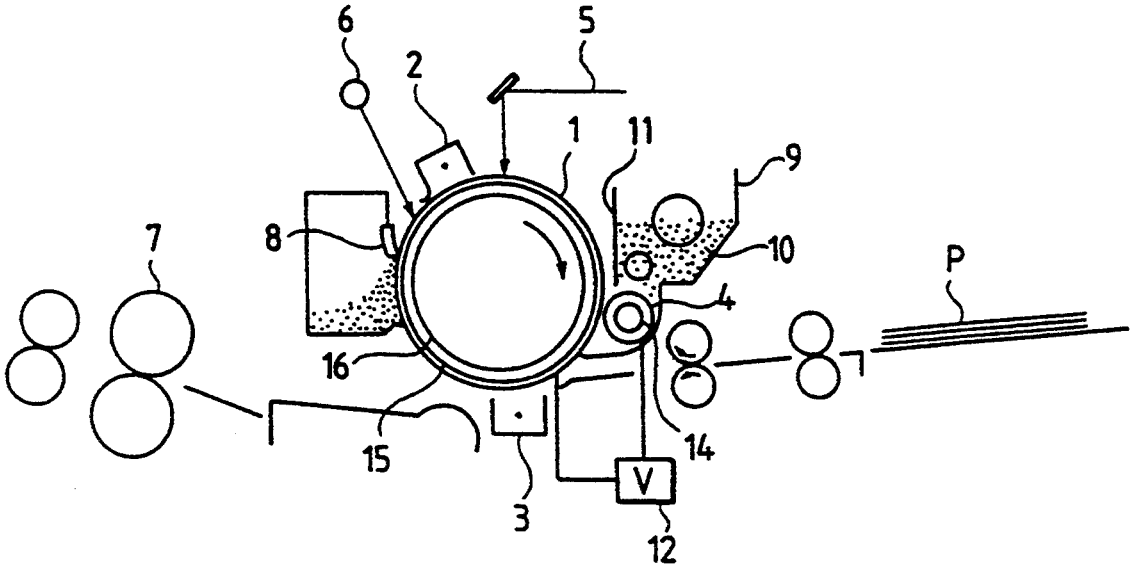
FIG. 1 is a schematic view showing the structure of an electrophotographic apparatus capable of using a cleaning blade according to the present invention.

In the present cleaning blade, a coating layer comprising lubricating particles and a binder resin is formed on the surface of a blade body having a rubbery elasticity. A third component may be contained in the coating layer, when required.

As the lubricating particles, well known solid lubricants of inorganic or organic material can be used in the present invention. The inorganic material includes, for example, talc, calcium carbonate, molybdenum disulfide, silicon dioxide, graphite fluoride and graphite. The organic material includes, for example, fluorocarbon resin, nylon resin (polyamide), silicone resin and polyacetal resin. Above all, fluorine-based compounds are particularly preferable owing to their low frictional resistance, irrespective of organic or inorganic compounds.

Powders of fluorine-based compounds include powders of, for example, graphite fluoride, polyvinylidene fluoride resin, ethylene tetrafluoride resin, ethylene tetrafluoride-propylene hexafuoride copolymer resin, ethylene tetrafluoride-perfluoroalkoxyethylene copolymer reisn, ethylene trifluoride chloride resin and ethylene tetrafluoride-ethylene copolymer resin.

Another desirable condition for the lubricating particles is a higher fixing force on the binder resin in the coating layer formed on the surface of the blade body. To meet this condition, particles of an irregular shape is preferred to particles of a spherical shape. A mechanical fixing force due to an anchoring effect can be obtained in the case that the particles are of an irregular shape besides a chemical bonding force of the binder resin to the particles, and thus the lubricating particles are less disengageable from the coating layer.

In view of these facts, graphite fluoride is particularly preferable as the substance of which the lubricating particles are compose because of their flake crystal, irregular shape and low frictional coefficient. Graphite fluoride includes, for example, $(C_2F)_n$ type such as Cefbon DM (product made by Central Glass K.K., Japan) a; $(CF)_n$ type such as Cefbon CMA and CMF (products made by Central Glass K.K., Japan), Carbon Fluoride #2065, #1030 and #1000 (products made by Asahi Glass K.K., Japan), CF-100 (product made by Nihon Carbon K.K., Japan); $(CF)_n$ type with varied fluorination degrees, such as Carbon Fluoride #2028 and #2010 (products made by Asahi Glass K.K., Japan); and the foregoing graphite fluorides treated with a base such as amines to remove fluorine from the surface, but is not limited thereto.

Furthermore, graphite fluoride has a low autocoagulating action. Thus, primary particles themselves are hard to coagulate into secondary particles, and the secondary particles themselves are hard to coagulate into such larger coagulations as balls. That is, the graphite fluoride can be effectively uniformly dispersed in the binder reisn.

Average particle size of the lubricating particles is preferably not more than 10 μm so as to not impair removal of toners by cleaning, and is more preferably 0.1 to 5 μm.

In the present invention, the average particle size of the lubricating particles is determined by observing the particles with an electron microscope and calculating the average particle sizes of the particles existing in a specific area.

The composition of the lubricating particles in the coating layer is preferably 1 to 200 parts by weight on the basis of 100 parts by weight of binder resin, and more preferably 5 to 50 parts by weight on the basis of 100 parts by weight of binder resin in view of the friction-reducing effect and the mechanical strength of the coating layer.

Any binder resin can be used in the present invention, so far as it can be usually used as a coating agent, but in view of its use as a coating layer on the surface of the blade body and use in pressing contact with the electrostatically charged latent image support, a resin with a good lubricability and a low frictional coefficient is preferable. Such a binder resin includes, for example, nylon resin (polyamide), silicone resin, polyacetal resin, and fluorocarbon resin.

The frictional coefficient of the binder resin is preferably 0.01 to 5, more preferably 0.5 to 2.5. The frictional coefficient is determined by a surface tester made by Heidon Co.

Other requirements for the binder resin are a trackability to the surface shape of electrostatically charged latent image support without any inhibition of elastic deformation of the blade body. Thus, the binder resin has a tensile modulus of elasticity of preferably 10 to $10^5$ kg/cm$^2$, and more preferably $10^2$ to $10^4$ kg/cm$^2$. The tensile modulus of elasticity is determined according to the JISK 7113 Procedure.

Still other requirements for the binder resin are wear resistance and maintenance of cleaning characteristics even by prolonged use. Thus, the binder resin has an attribution loss of preferably 0.1 to 1,000 mg, more preferably 0.1 to 100 mg, and most preferably 0.1 to 10 mg, determined according to the JIS K 7204 procedure (1,000 g of GC150H grindstone, 1,000 revolutions)

In view of these observations, a coating agent of amide resin material such as nylon is particularly preferable as the binder resin.

From the viewpoint of easy production, the coating agent is preferably solvent-soluble and includes, for example, commercially available Platamid M1276 and M995 (made by PLTE BONN Co.), CM4000 and CM8000 (made by Toray K.K. ), and T171 (made by Dicel-Huels K.K. ), and self-crosslinkable Toresin F30, MF30 and EF30T (made by Teikoku Kagaku Sangyo K.K.), and those cross-linked with melamine resin, but the coating resin is not limited to these resins.

The thickness of the coating layer comprising lubricating particles and the binder resin according to the present invention is preferably 1 to 100 μm, and more preferably 5 to 30 μm in view of the influence of the blade body upon the elastic deformation, durability, adhesiveness, and other conditions. In the present invention the thickness of the coating film is determined with observing the cut surface by a tool microscope.

The solvent for dissolving the binder resin includes known solvents, for example, an alcoholic solvent, a chlorinic solvents, a ketonic solvents, an esteral solvents and their mixtures, and water. It is preferable to select a solvent having no influence upon the blade body materials. For example, in the case that the blade body is made of polyurethane, it is preferable to select an alcohol solvent as the solvent for dissolving the binder resin.

In the present invention, it is necessary to use material having a rubbery elasticity for the blade body. The materials having a rubbery elasticity include, for example, polyurethane rubber, silicone rubber, nitrile rubber and chloroprene rubber. The materials for use in the blade body have a modulus of elasticity of preferably 10 to $10^3$ kg/cm$^2$, and more preferably 20 to 100 kg/cm$^2$. The modulus of elasticity is determined according to the JIS K6301 procedure.

Other requirements for the materials for use in the blade body are a small fluctuation in the pressing force to the electrostatically charged latent image support, that is, a low permanent set, and a good adhesiveness to the coating layer.

As to the fluctuation in the pressing force of a cleaning blade onto the electrostatically charged latent image support, there is such a problem that, when the fluctuation amplitude is lower than a predetermined minimum pressing force, removal of remaining toners by cleaning fails. Thus, it is necessary to maintain a desired pressing force. However, rubber may undergo irreversible deformation due to plastic flow within the rubber, that is, creep, within the rubber and thus the compression set of the rubber for use in the blade body is preferably not more than 20%, and more preferably 10 to 1%, determined according to the JIS K6301 procedure.

In view of the foregoing observations, it is preferable to use polyurethane rubber as the rubber for use in the blade body. Two-pot type, thermo-settable, molding-type polyurethane rubber is particularly preferable among the polyurethane rubbers owing to a low permanent set.

The preferable polyol component of the polyurethane rubber includes, for example, adipate-based polyesterpolyol, lactone-based polyesterpolyol, copolymerized polyesterpolyol, polycarbonate-based polyol, polypropylene-based polyetherpolyol, polyethylene-based polyetherpolyol, polytetramethylene-based polyetherpolyol, copolymerized polyether-based polyol, and mixtures of these polyol component.

The preferable polyisocyanate component includes, for example, 2,4-tolylenediisocyanate (TDI), its isomers and their mixtures, 4,4'-diphenylmethanediisocyanate (MDI), poly MDI, 1,5-naphthalenediisocyanate (NDI), hexamethylenediisocyanate, MDI hydride, and polyfunctional, modified polyisocyanate. The preferable chain-extending component acting as a curing agent includes, for example, bifunctional amine compounds and dihydroxy compounds. The preferable cross-linking component acting as a curing agent includes, for example, trifunctional and higher functional glycol-based compounds. Examples of these curing agents include ordinary urethane curing agents such as 1,4-butanediol, 1,6-hexanediol, hydroquinonediethylolether, bisphenol A, trimethylolpropane, and trimethylolethane.

The rubber hardness is so set as to press the cleaning member onto a photosensitive member at least at a predetermined distance and under a predetermined load to obtain a desired pressing force from the viewpoint of removability of the remaining toners by cleaning. If the hardness is too low, the pressing force will be insufficient and the rubber stiffness will be also insufficient, so that the cleaning member may be brought in contact with the photosensitive member in a larger contact area, resulting in an increase in the frictional force during the sliding, which will lead to deterioration of slidability. Thus, the JIS A hardness is desirably not less than 40°. On the other hand in the case of a cleaning member having a higher hardness, the pressing force onto the surface of the photosensitive member such as organic photosensitive semiconductors, etc. will be increased, resulting in a cause for damaging the photosensitive drum surface. Thus, the JIS A hardness is preferably not higher than 90°. The JIS A hardness is more preferably 50° to 80°.

The present cleaning blade can be prepared in the following manner: lubricating particles such as graphite fluoride powder dispersed in a solution of binder resin such as nylon resin in a solvent such as an alcohol, and then the resulting solution is applied to a plate shaped, or chip-shaped blade body prepared in advance by a coater bar, a spray, a dispenser or screen printing or by dipping while controlling the thickness as desired. The cleaning blade can be also prepared by laminating a coating layer formed in advance onto the blade body.

In order to bring the coating layer of the cleaning blade into uniform contact with the surface of the electrostatically charged latent image support, it is preferable to apply a lubricating member onto the blade body surface and then to cut the blade body to form a sliding ridge. In the case of a composite member as in the present cleaning blade, uneven deformation and strains are brought about within the composite member upon application of a stress owing to different moduluses of elasticity and plastic deformabilities, resulting in an increase in the roughness on the ridge formed by cutting and an adverse effect on the ridge straightness.

Figure 2:
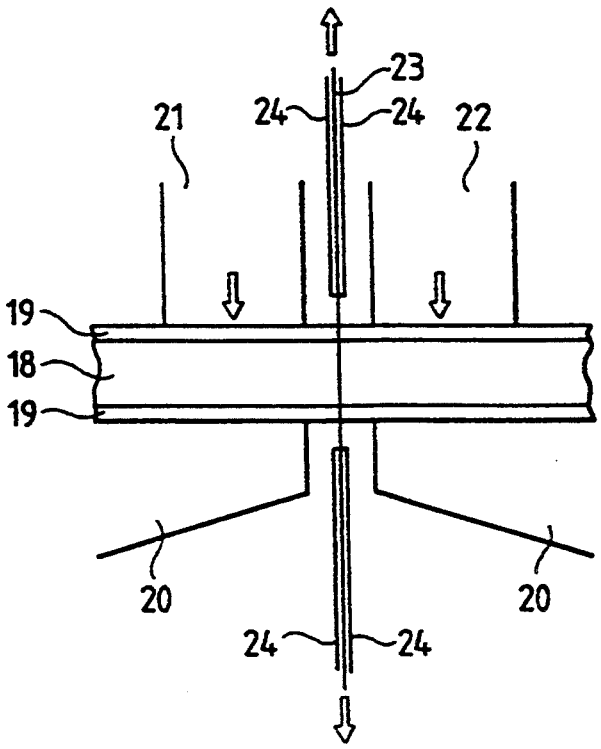
FIG. 2 is a schematic view showing a cutting method for forming a sliding ridge on a cleaning blade from a composite material comprising a blade body and a lubricating coating layer formed on the surface of the blade body.

In the cutting of a composite member comprising a blade body and a coating layer of the present invention, it is effective, as shown in FIG. 2, to hold the composite member comprising a blade body 18 and coating layers 19 between the recepter members 20 and 20 and pressing members 21 and 22 without providing any tension and deformation to the composite member, that is, without developing an internal strain on the composite member and lowering the resistance of cutter knife 23 during the cutting. For example, it is preferable to use a cutter knife having an edge thickness of 0.05 to 0.1 mm and an edge width of not more than 10 mm that can pass through the composite member. It is also preferable to cut the composite member with the cutter knife while the knife is extended and retained so as to overcome the resistance of the cutter knife during cutting. This cutting procedure is effective not only for cutting the composite member such as the present cleaning blade, but also for cutting conventional elastomers such as urethane rubber. The resistance of the cutter knife can be lowered by applying heat to the cutter knife by a heater 24 up to the melting point temperature of the binder resin of the coating layer plus 50° C., thereby softening and melting the binder resin during the cutting, and a good sliding ridge can be obtained thereby. According to the heated cutting procedure, a good sliding ridge can be obtained even with a cutter knife having an edge thickness of not more than 0.25 mm.

Figure 3:
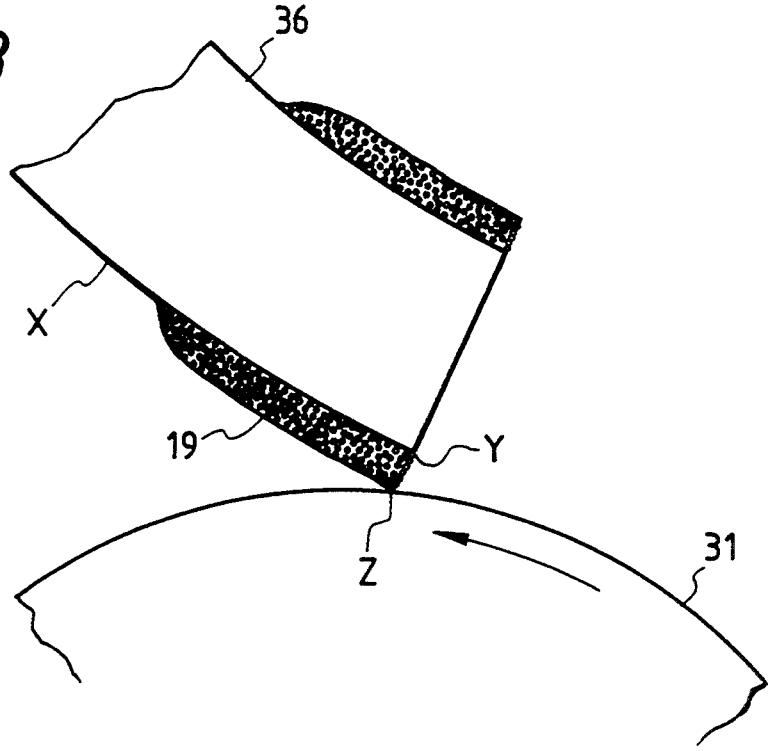
FIG. 3 is a cross-sectional view showing a contact state of the present cleaning blade with an electrostatically charged latent image support.

As shown in FIG. 3, in the cleaning blade 36 prepared in the foregoing manner lubricating particles are directly exposed from the binder resin by the cutting at the contact surface 2 between the coating layer 19 formed on the surface X in parallel to the axial direction of the blade body and at the edge Y of the blade body on the side in contact with the electrostatically charged latent image support 31 and the electrostatically charged latent image support 31, whereby the lubricating particles in the coating layer 19 can be brought in direct contact with the electrostatically charged latent image support 31 and thus the frictional coefficient of the cleaning blade can be lowered.

Figure 4:
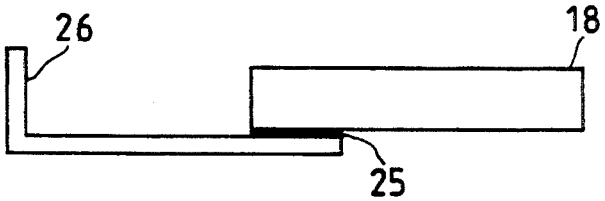
FIG. 4 is a cross-sectional view showing one embodiment of a cleaning blade.
Figure 5:
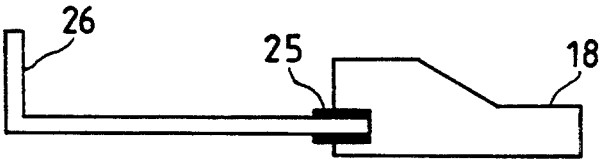
FIG. 5 is a cross-sectional view showing another embodiment of a cleaning blade.
Figure 6:
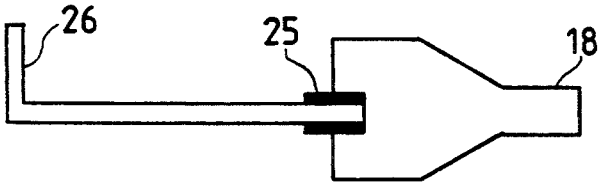
FIG. 6 is a cross-sectional view showing another embodiment of a cleaning blade.

Typical examples of the structure of the present cleaning blade are shown in FIGS. 4, 5 and 6, where the blade body 18 is fixed to a support metal plate 26 by an adhesive 25.

Examples of the position of the coating layer 19 to be formed on the surface of blade body 18 are shown in FIGS. 7, 8, 9 and 10.

Figure 7:
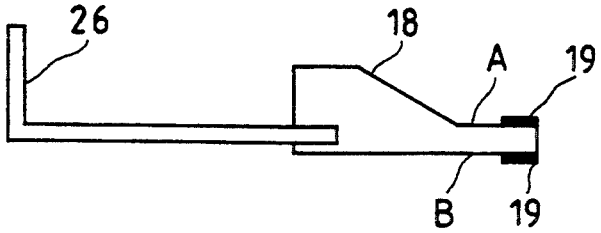
FIG. 7 is a cross-sectional view showing one embodiment of the present cleaning blade with a coating layer.
Figure 8:
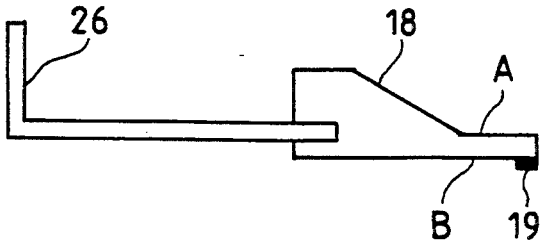
FIG. 8 is a cross-sectional view showing another embodiment of the present cleaning blade with a coating layer.
Figure 9:
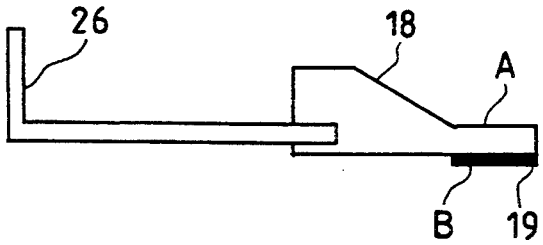
FIG. 9 is a cross-sectional view showing another embodiment of the present cleaning blade with a coating layer.
Figure 10:
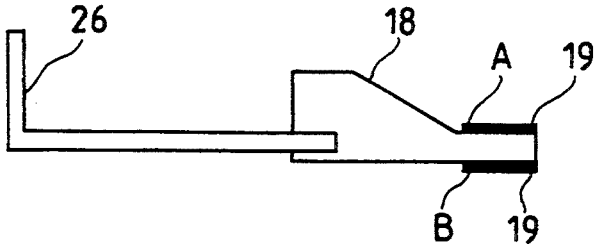
FIG. 10 is a cross-sectional view showing further embodiment of the present cleaning blade with a coating layer.

In the case of application with a solvent, strains are formed by contraction due to evaporation of the solvent from the applied coating layer. In the case of application of a coating layer of different modulus of elasticity only onto the entire surface on the side B, as shown in FIG. 9, strains are formed in the direction of warping depending on the thickness of the applied coating layer and also due to the shrinkage in the longitudinal direction of the sliding ridge, resulting in poor straightness of the sliding ridge. Thus, it is preferable to apply the coating layer to both surfaces A and B, as shown in FIGS. 7 and 10 or only to the tip end of the surface B, as shown in FIG. 8.

The thickness and surface roughness of the coating layer can be controlled by a concentration of binder resin in a solution containing lubricating particles dispersed therein, that is, a ratio of lubricating particles: binder resin: solvent by weight. For example, by increasing the amount of the lubricating particles to be dispersed, thereby lowering the relative amount of the binder resin, the surface roughness of the coating layer can be increased and the frictional force of the cleaning blade can be lowered.

When the surface roughness is larger than the average particle size of toners used in the electrophotography, and when the ridge of the cleaning blade is brought into pressing contact with the photosensitive drum, no sufficient deformation will be formed at the ridge in the pressing contact, resulting in locally incomplete sliding on the photosensitive drum surface, deteriorating the removal of remaining toners by cleaning. When the surface roughness is too low, the adhesiveness will be increased between the photosensitive drum and the cleaning blade ridge, resulting in failure to obtain a slidability of low friction. Thus, the surface roughness of the coating layer is preferably 0.5 to 5 μm, where the surface roughness is defined by centerline average roughness (Ra).

The lubricating particles can be directly exposed from the binder resin by grinding the surface of the coating layer with a grinding material to remove the binder resin, as by the above-mentioned preferable procedure, whereby the surface roughness of the coating layer can be increased and the frictional force can be lowered. In that case the degree of exposure of the lubricating particles to the surface of the coating layer and also the frictional force can be controlled by the degree of grinding.

The present cleaning blade comprising a blade body and a coating layer comprising lubricating particles and a binder resin that covers the surface of the blade body has a frictional coefficient of preferably 0.01 to 1.5, and more preferably 0.1 to 0.6.

An electrophotographic apparatus having a cleaning device comprising the present cleaning blade provided in pressing contact with an electrostatically charged latent image support will be explained below, referring to FIG. 1.

The surface of a photosensitive member 1 as an electrostatically charged latent image support is negatively charged by a primary charger 2 as a charging means and a digital latent image is formed thereon by image scanning with a light exposure 5 based on a laser beam as a latent image-forming means. The latent image is subjected to reversal development with a single component magnetic developing agent 10 containing magnetic toners in a developer 9 provided with a developing sleeve comprising a magnetic blade 11 and a magnet 14. During the development an alternating bias, a pulse bias and/or a DC bias are applied between the electroconductive substrate 16 of electrostatically charged latent image support 1 and the developing sleeve 4 by a bias-applying means 12.

The electrostatically charged latent image support (photosensitive drum) 1 having a photosensitive layer 15 of polycarbonate resin comprising a charge generation layer and a charge transfer layer and an electroconductive substrate 16 of aluminum rotates in the direction shown by the arrow in FIG. 1, and the developing sleeve 4 of a non magnetic cylinder as a developing agent carrier rotates in the same direction as that of the surface of the electrostatically charged latent image support 1 in the developing region. At the inside of the developing agent carrier 4, a multipolar permanent magnet (magnet roll) 14 as a magnetic field-producing means is provided free from rotation and the single component, insulating magnetic developing agent 10 in the developer 9 is applied to the surface of the developing agent carrier 4. A minus tribocharge is given to toners by friction between the surface of developing agent carrier 4 and the toners. Furthermore, the developing agent layer is controlled to a uniform, small thickness (30 to 300 μm) by a magnetic steel doctor blade 11 counterposed to one of the magnetic pole positions of the multipolar permanent magnet and near the surface of the developing agent carrier 4 (distance: 50 to 500 μm), and thus the developing agent layer can be formed smaller than the clearance between the electrostatically charged latent image support 1 and the developing agent carrier 4 and free from the contact therefrom.

Then, a transfer sheet P as a transfer material is fed to the transfer region and is positively charged on the back side of transfer sheet P (opposite side to the electrostatically charged latent image support 1) by a transfer charger 3 as a transfer means, whereby the negatively charged toner image can be electrostatically transferred onto the surface of the electrostatically charged latent image support 1. The transfer sheet P separated from the electrostatically charged latent image support 1 is passed through a heated press roller fixing device 7 as a fixing means to fix the toner image on the transfer sheet P.

The single component developing agent containing magnetic toners, remaining on the electrostatically charged latent image support 1 leaving the transfer region is removed by a cleaning device 8 having the present cleaning blade. The cleaned electrostatically charged latent image support 1 is discharged by an erasing light exposure 6 and returned to the steps starting with the charging step with the primary charger 2.

Even in an electrophotographic apparatus for transferring the toner image on the surface of the electrostatically charged latent image support with a binary developing agent containing toners and carrier particles, the toners remaining on the surface of the electrostatically charged latent image support 1 can be removed by the cleaning device 8 having the present cleaning blade in the same manner as in the case of the single component developing agent.

Figure 16:
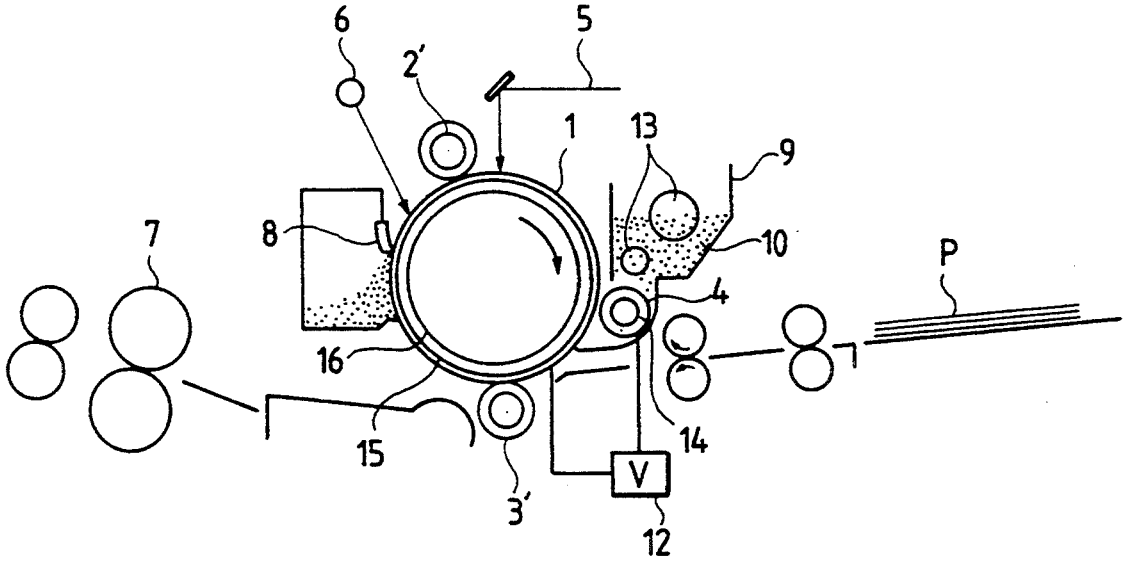
FIG. 16 is a schematic view showing the structure of another electrophotographic apparatus capable of using the present cleaning blade.

FIG. 16 shows another embodiment of an electrophotographic apparatus using a contact roller charger 2' and a contact roller transfer device 3' for charging and transferring by direct contact of the electrostatically charged latent image support or by contact therewith through a transfer material, respectively, in place of the primary charger and the transfer charger of the electrophotographic apparatus shown in FIG. 1.

Figure 11:
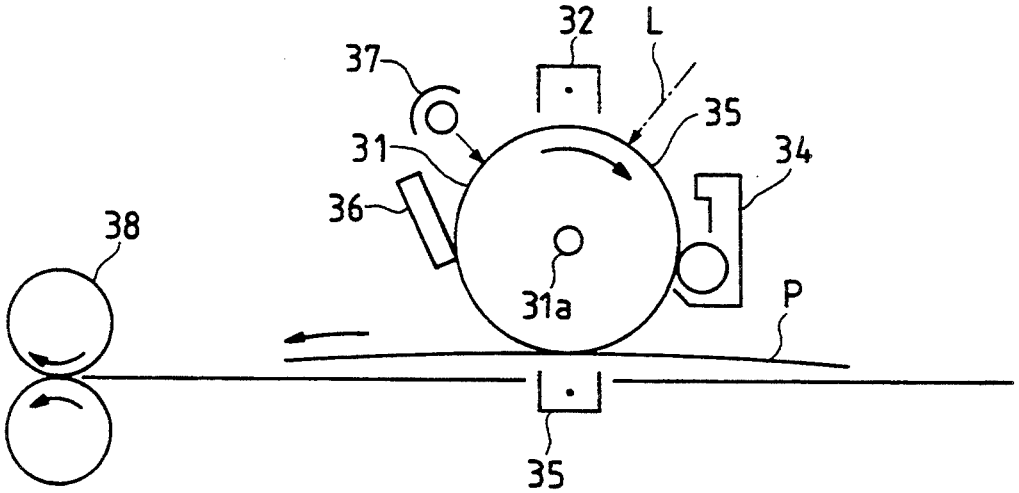
FIG. 11 is a schematic view showing the structure of an ordinary, transfer-type electrophotographic apparatus using the present cleaning blade.

FIG. 11 is a schematic view of an electrophotographic apparatus having a cleaning device with the present cleaning blade in pressing contact with an electrostatically charged latent image support, where numeral 31 denotes a drum type, photosensitive member as an electrostatically charged latent image support, which is driven to rotate at a predetermined peripheral speed in the direction of the arrow shown in FIG. 11 at the center of a shaft 31*a*. The photosensitive member 31 is positively or negatively uniformly charged to a predetermined potential on the peripheral surface by a charging means 32 and is then subjected to a light image exposure L (slit light exposure or laser beam scanning exposure) in a light exposure region 35 by a latent image-forming means (not shown in the drawing), whereby electrostatically charged latent images corresponding to exposed light images are successively formed on the peripheral surface of the photosensitive member.

Then, the electrostatically charged latent images are developed with toners by a developing means, and the toner-developed images are successively transferred on the surfaces of transfer sheets P fed from the sheet-feeding region (not shown in the drawing) to the position between the photosensitive member 31 and the transfer means 35 by a transfer means 35 and synchronously with the rotation of the photosensitive member 31. The transfer sheets P with the transferred toner images are separated from the surface of the photosensitive member 31, led to a fixing means 38 to fix the images, and printed out and output from the apparatus as copies.

After the transfer operation, the surface of the photosensitive member 31 is cleaned by the present cleaning blade 36 to remove toners remaining on the surface thereby obtaining a clean surfaced, which is discharged by a prelight exposure means 37. Then, the photosensitive member is again used in image formation.

A corona charging device is usually used as a uniformly charging means 32 for the photosensitive member 31. A roller type, contact charging device can be also used. A corona transfer means is also usually used as the transfer device 35. A roller type, contact charging device can be also used. The electrophotographic apparatus can be constructed by integrating a plurality of constituent members such as an electrostatically charged latent image support, a charging means, a developing means and a cleaning blade into one apparatus unit upon selection, and by making the apparatus unit detachable to the apparatus proper. For example, at least one of the charging means and the developing means may be integrated with the electrostatically charged latent image support and the cleaning blade to form a single unit detachable to the apparatus proper. That is, the single unit can be made detachable from the apparatus proper by a guide means, such as rails, etc. of the apparatus proper. The apparatus proper may be integrated with the charging means and/or the developing means.

When the electrophotographic apparatus is used as a copying machine or a printer, the light image exposure L can be carried out by reflected light or transmitted light from a manuscript or by reading and signalizing a manuscript and scanning a laser beam, driving an LED array, or driving a liquid crystal shutter array on the basis of the signals.

Figure 12:
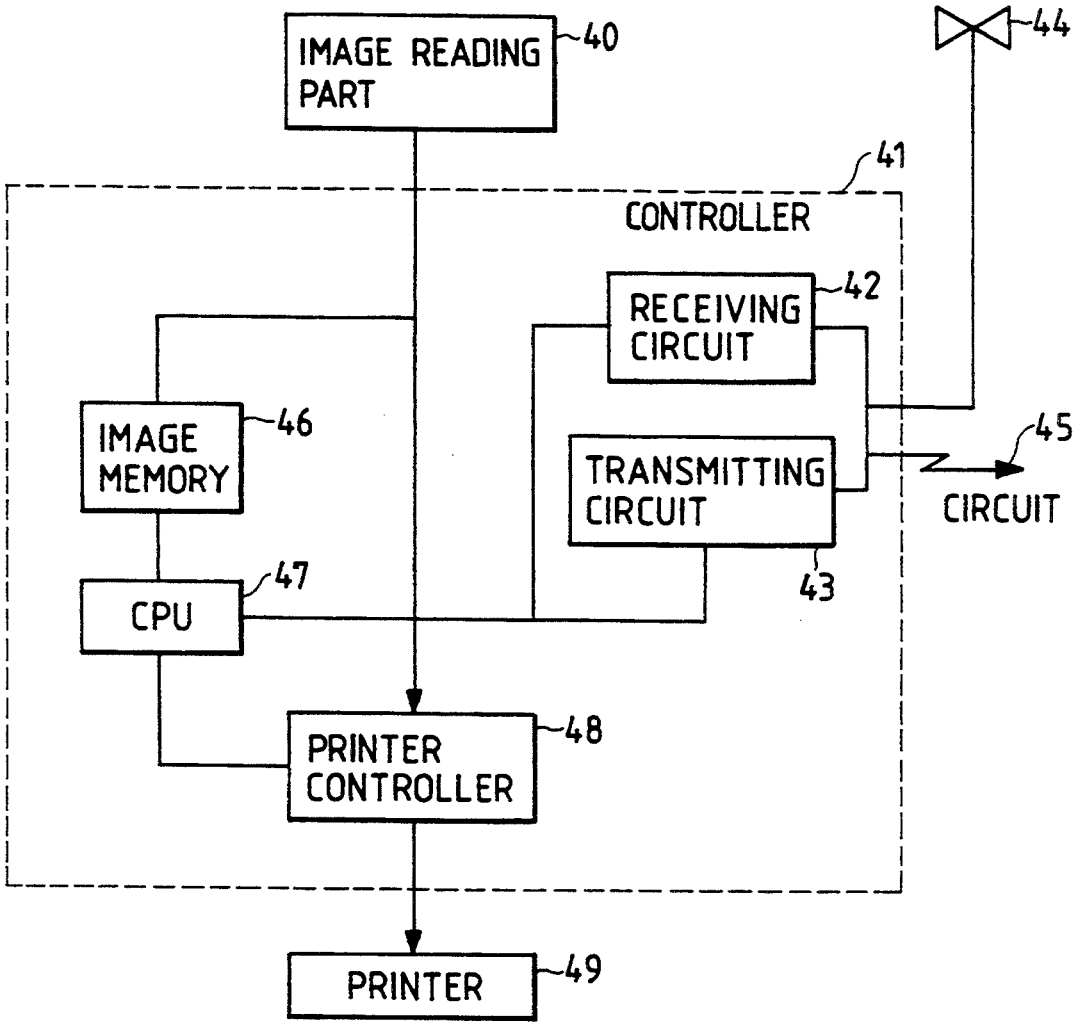
FIG. 12 is a block diagram of a facsimile 10 using an electrophotographic apparatus with the present cleaning blade as a printer.

When the electrophotographic apparatus is used as a facsimile printer, the light image exposure L acts as light exposure for printing received data. FIG. 12 is a block diagram showing one example of that embodiment.

A controller 41 in this embodiment controls an image reading part 40 and a printer 49. The entire controller 41 is controlled by a CPU 47. The read data from the image reading part is transmitted to the counterpart station through a transmitting circuit 43. Data received from the counterpart station is sent to a printer 49 through a receiving circuit 42. Predetermined image data are stored in an image memory. A printer controller 48 controls the printer 49. Numeral 44 denotes a telephone.

The image received from the circuit 45 (image information from a remote terminal connected through the circuit) is demodulated in the receiving circuit, and then the CPU 47 conducts a decoding treatment of the image information and decoded image information is successively stored in the image memory 46. When at least one page of images is stored in the memory 46, image recording of the page is carried out. CPU 47 reads out one page of image information from the memory 46 and emits one page of decoded image information to the printer controller 48. Upon receipt of the one page of image information from CPU 47, the printer controller 48 controls the printer 49 to conduct image information recording for that page. CPU 47 receives the next page during the recording by the printer 49. Receiving and recording of images are carried out in the foregoing manner.

The present cleaning blade has the following effects owing to a coating layer comprising lubricating particles and a binder resin having good lubricability and wear resistance on the surface of the blade body having a rubbery elasticity.

(1) When a cleaning blade is used in pressing contact with an electrostatically charged latent image support, the cleaning blade can clean the electrostatically charged latent image support in good contact of the coating layer containing lubricating particles on the blade body surface therewith to surely remove the toners remaining thereon without turning-up of the cleaning blade owing to a large decrease in the frictional coefficient due to both the lubricating particles and the binder resin.

(2) Since the lubricating particles are contained in the coating layer together with the binder resin, the lubricating particles are not disengaged from the coating layer, and since the binder resin has a wear resistance, attrition loss of the coating layer is less or smaller during the prolonged use, whereby the cleaning blade can have a stable, low frictional performance.

(3) Since the cleaning blade surface has a low frictional performance, the electrostatically charged latent image support can continuously hold good images with no or less scraping-off of the surface of the electrostatically charged latent image support.

In the present cleaning blade, the coating layer containing the lubricating particles and the binder resin on the surface of the blade body having a rubbery elasticity is formed on the surface in parallel to the axial direction of the blade body and at least at the edge of the blade body on the side in contact with the electrostatically charged latent image support, and the lubricating particles are directly exposed in the binder resin on the contact surface of the coating layer with the electrostatically charged latent image support, and thus the following additional effects can be obtained.

(4) The frictional coefficient can be largely lowered owing to the lubricating particles directly exposed in the binder resin, and thus the same effects as in the above (1) to (3) can be obtained.

PREFERRED EMBODIMENTS OF THE INVENTION

The present invention will be explained in detail below, referring to the following Examples, to which is not limited the present invention.

EXAMPLE 1

Blade body
- Rubber material
- Ethylene adipate-based urethane prepolymer (made by Nihon Polyurethane Kogyo K.K.): 100 parts by weight
- Number average molecular weight (Mn): 1500
- Isocyanate content (NCO): 6.2 wt. %
- Curing agent
- 1,4-butanediol: 3.9 parts by weight
- Trimethylolpropane: 2.1 parts; by weight
- Molding conditions
- Temperature: 130° C.
- Time: 30 minutes
- Secondary vulcanization condition
- Temperature: 130° C.
- Time: 4 hours
- Rubber hardness : JIS A 62° C.
- Compression set (70° C.): 9%
- Modulus of elasticity: 45 kg/cm$^2$ Binder resin
- Polyamide resin (PLATAMID ® M995, trademark of a product made by PLTE BONN Co.)
- Tensile modulus of elasticity: 1570 kg/cm$^2$
- Frictional coefficient: 1.9
- Attrition loss: 5 mg Lubricating particles
- Graphite fluoride (Cefbon-DM, trademark of a produce made by Central Glass K.K.)
- Average particle size: 3 μm Preparation of cleaning blade Heat-molten uretahne prepolymer was mixed with 1,4-butanediol and trimethylol propane as curing agents, and the mixture was poured into a mold provided with a support plate metal pretreated for adhesion at the part to be connected with rubber in advance, and cured with heating to make a blade body of predetermined shape.

Figure 13:
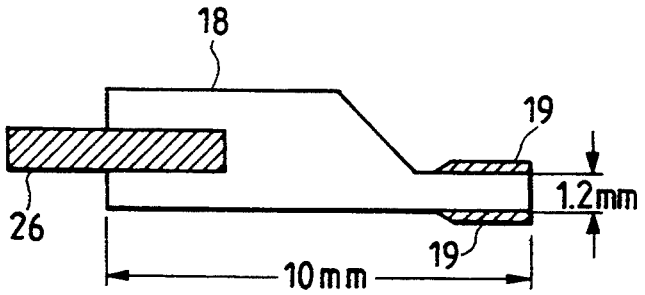
FIG. 13 is a cross-sectional view showing a further embodiment of the present cleaning blade.

Separately, 20 parts by weight of polyamide resin (PLATAMID ®) was dissolved in 100 parts by weight of methyl alcohol and 4 parts by weight of graphite fluoride ( Cefbon-DM ) was uniformly dispersed in the solution. Then, the resulting coating solution was applied to the tip end part of the blade body by dipping and air-dried and then dried with heating at 130° C. for 10 minutes to form a coating layer. Then, the tip end of the blade was cut using a cutting apparatus shown in FIG. 2 to prepare a cleaning blade 20 of the present invention comprising a support plate metal 26, a blade body 18 and a coating layer 19, as shown in FIG. 13, and having a width of 10 mm, a total length of 240 mm, a tip end thickness of 1.2 mm and a coating layer thickness of 10 μm.

EXAMPLE 2

Blade body
- Rubber material
- Ethylene adipate-based urethane polymer (made by Nihon Polyurethane Kogyo K.K.): 100 parts by weight
- Number average molecular weight (Mn): 1500
- Isocyanate content (NCO): 6.2 wt. %
- Curing agent
- 1,4-butanediol: 3.9 parts by weight
- Trimethylolpropane: 2.1 parts by weight
- Molding conditions
- Temperature: 130° C.
- Time: 30 minutes
- Secondary curing conditions
- Temperature: 130° C.
- Time: 4 hours
- Rubber hardness: JIS A 62° C.
- Compression set (70° C.): 9%
- Modulus of elasticity: 45 kg/cm Binder resin
- Polyamide resin (Toresin EF30T, trademark of a product made by Teikoku Kagaku Sangyo K.K.)
- Tensile modulus of elasticity: 1320 kg/cm
- Frictional coefficient: 2.1
- Attrition loss: 8 mg Lubricating particles
- Graphite fluoride (Carbon fluoride #2028, trademark of a product made by Asahi Glass K.K.)
- Average particle size: 0.3 μm Preparation of Cleaning blade Heat molten urethane prepolymer was mixed with 1,4-butanediol and trimethylolpropane as curing agents and the mixture was poured into a mold provided with a plate metal in advance and cured with heating, and a blade body of polyurethane having a width of 10 mm, a total length of 240 mm and a tip end thickness of 1.2 mm was prepared therefrom by cutting.

Separately, 10 parts by weight of polyamide resin (Toresin) was dissolved in 20 parts by weight of methyl alcohol and 80 parts by weight of isopropyl alcohol in advance and 2 parts by weight of graphite fluoride (Carbon fluoride #2028) was uniformly dispersed in the resulting solution. Then, the resulting coating solution was applied to the tip end part of the blade body by dipping, air-dried and then dried with heating at 150° C. for 20 minutes to conduct self-cross-linking of the polyamide resin to prepare a cleaning blade having a coating layer thickness of 5 μm.

EXAMPLE 3

Blade body
- Rubber material
- Ethylene adipate-based urethane prepolymer (made by Nihon Polyurethane Kogyo K.K.): 100 parts by weight
- Number average molecular weight (Mn): 1500
- Isocyanate content ( NCO ): 6.2 wt. %
- Curing agent
- 1,4-butanediol: 3.9 parts by weight
- Trimethylolpropane: 2.1 parts by weight
- Molding conditions
- Temperature: 130° C.
- Time: 30 minutes
- Secondary vulcanization conditions
- Temperature: 130° C.
- Time: 4 hours
- Rubber hardness : JIS A 62° C.
- Compression set (70° C.): 9%
- Modulus: 45 kg/cm Binder resin
- Polyamide resin (Toresin EF30T, trademark of a product made by Teikoku Kagaku Sangyo K.K.)
- Tensile modulus of elasticity: 1320 kg/cm
- Frictional coefficient: 2.1
- Attrition loss: 8 mg Lubricating particles
- Graphite fluoride (Carbon fluoride #2028, trademark of a product made by Asahi Glass K.K.)
- Average particle size: 0.3 μm Preparation of Cleaning blade Heat molten urethane prepolymer was mixed with 1,4-butanediol and trimethylol propane as curing agents, and the mixture was poured into a mold provided with a plate metal in advance, and a blade body of polyurethane having a width of 10 mm, a total length of 240 mm, and a tip end thickness of 1.2 mm was prepared therefrom by cutting.

Separately, 10 parts by weight of polyamide resin (Toresin) was dissolved in 20 parts by weight of methyl alcohol and 80 parts by weight of isopropyl alcohol, and 2 parts by weight of graphite fluoride (Carbon fluoride #2028) was uniformly dispersed in the solution. Then, the resulting coating solution was applied to the tip end part of the blade body dipping and air-dried and then dried with heating at 150° C. for 20 minutes to allow self-cross-linking of the polyamide resin. A cleaning blade of the present invention having a coating layer thickness of 5 μm was prepared thereby.

COMPARATIVE EXAMPLE 1

Blade body
- Rubber material
- Ethylene adipate-based urethane prepolymer made by Nihon Polyurethane Kogyo K.K.: 1.00 parts by weight
- Number average molecular weight (Mn): 1500
- Isocyanate content (NCO): 6.2 wt. %
- Curing agent
- 1,4-butanediol: 3.9 parts by weight
- Trimethylolpropane: 2.1 parts by weight
- Molding conditions
- Temperature: 130° C.
- Time: 30 minutes
- Secondary vulcanization conditions
- Temperature: 130° C.
- Time: 4 hours
- Rubber hardness : JIS A 62° C.
- Compression set (70° C.): 9%
- Modulus: 45 kg/cm Preparation of Cleaning blade Heat molten urethane prepolymer was mixed with 1,4-butanediol and trimethylolpropane as curing agents, and the mixture was poured into a mold provided with a plate metal in advance, and cured with heating. A blade body of polyurethane having the same dimensions as in Example 1 was prepared therefrom by cutting and used as a cleaning blade.

COMPARATIVE EXAMPLE 2

Blade body
- Rubber material
- Ethylene adipate-based urethane prepolymer made by Nihon Polyurethane Kogyo K.K.): 100 parts by weight
- Number average molecular weight: 1500
- Isocyanate content (NCO): 6.2 wt. %
- Curing agent
- 1,4-butanediol: 3.9 parts by weight
- Trimethylolpropane: 2.1 parts by weight
- Molding conditions
- Temperature: 130° C.
- Time: 30 minutes
- Secondary vulcanization conditions
- Temperature: 130° C.
- Time: 4 hours
- Rubber hardness : JIS A 62° C.
- Compression set (70° C.): 9%
- Modulus of elasticity : 45 kg/cm Lubricating particles
- Polyvinylidene fluoride (Kynar 500, trademark of a product made by Pennwalt Prescription Products)
- Average particle size: 0.3 μm Preparation of Cleaning blade Heat molten urethane prepolymer was mixed with 1,4-butanediol and trimethylolpropane as curing agents, and the mixture was poured into a mold provided with a plate metal in advance and cured with heating. A blade body of polyurethane having the same dimensions as in Example 1 was prepared by cutting. Polyvinylidene fluoride (Kynar 500) was applied onto the tip end part of the blade body by rubbing to prepare a cleaning blade.

COMPARATIVE EXAMPLE 3

Blade body
- Rubber material
- Ethylene adipate-based urethane prepolymer (made by Nihon Polyurethane Kogyo K.K.): 100 parts by weight
- Number average molecular weight (Mn): 1500
- Isocyanate content (NCO): 6.2 wt. %
- Curing agent
- 1,4-butanediol: 3.9 parts by weight
- Trimethylolpropane 2.1 parts by weight
- Molding conditions
- Temperature: 130° C.

Time: 30 minutes
Secondary vulcanization conditions
Temperature: 130° C.
Time: 4 hours
Rubber hardness: JIS A 62° C.
Compression set (70° C.): 9%
Modulus of elasticity: 45 kg/cm Binder resin Polyamide resin (CM4000, trademark of a product made by Toray K.K.)
Tensile modulus of elasticity: 5,500 kg/cm
Frictional coefficient: 1.9
Attrition loss: 2 mg Preparation of Cleaning blade Heat molten urethane prepolymer was mixed with 1,4-butanediol and trimethylolpropane as curing agents, and the mixture was poured into a mold provided with a plate metal in advance, and cured with heating to prepare a blade body of polyurethane.

Separately, 10 parts by weight of polyamide resin (CM4000) was dissolved in 50 parts by weight of methyl alcohol and 50 parts by weight of chloroform in advance, and the resulting coating solution was applied to the tip end part of the blade body and air-dried and then dried with heating at 130° C. for 10 minutes to form a coating layer. Then, the blade was cut to prepare a cleaning blade having a width of 10 mm, a total length of 240 mm, a tip end thickness of 1.2 mm and a coating layer thickness of 15 μm.

EXAMPLE 4

Blade body

Rubber material
Ethylene adipate-based urethane prepolymer
(made by Nihon Polyurethane Kogyo K.K.): 100 parts by weight
Number average molecular weight (Mn): 1500
Isocyanate content (NCO): 6.2 wt. %
Curing agent
1,4-butanediol: 3.9 parts by weight
Trimethylolpropane: 2.1 parts by weight
Molding condition
Temperature: 130° C.
Time: 30 minutes
Secondary vulcanization conditions
Temperature: 130° C.
Time: 4 hours
Rubber hardness: JIS A 62° C.
Compression set (70° C.): 9%
Modulus: 45 kg/cm Binder resin Polyamide resin (CM4000, trademark of a product made by Toray K.K.)
Tensile modulus of elasticity: 5500 kg/cm
Frictional coefficient: 1.9
Attrition loss: 2 mg Lubricating particles Graphite fluoride (Cefbon DM, trademark of a product made by Central Glass K.K.)
Average particle size: 3 μm Preparation of Cleaning blade Heat molten urethane prepolymer was mixed with 1,4-butanediol and trimethylolpropane of curing agents, and the mixture was poured into a mold provided with a plate metal in advance and cured with heating to prepare a blade body of polyurethane.

Separately, 20 parts by weight of polyamide resin (CM4000) was mixed with 100 parts by weight of methyl alcohol in advance, and 3 parts by weight of graphite fluoride (Cefbon-DM) was uniformly dispersed in the solution. The resulting coating solution was applied to the tip end part of the blade body by dipping, air-dried and then dried with heating at 80° C. for 10 minutes to form a coating layer. Then, the blade was cut to prepare a cleaning blade of the present invention having a width of 10 mm, a total length of 240 mm, a thickness of 1.2 mm and a coating layer thickness of 12 μm, as shown in FIG. 7.

Each thus prepared cleaning blade was mounted on an electrophotographic apparatus based on a contact charging system, as shown in FIG. 16, to evaluate the blade reverse, the cleaning property and the image quality. The results are shown in Table 1. Also, the frictional coefficients of the respective cleaning blades were determined and the results are shown in Table 1.

TABLE 1

| | | Ex. 1 | Ex. 2 | Ex. 3 | Comp. Ex. 1 | Comp. Ex. 2 | Comp. Ex. 3 | Comp. Ex. 4 |
|---|---|---|---|---|---|---|---|---|
| Frictional coefficient (μ) | Room temp. | 0.5 | 0.6 | 0.6 | failed to measure | 0.5 | 1.9 | 0.5 |
| | Temp. 40° C./ Humidity 90% RH | 0.5 | 0.6 | 0.6 | failed to measure | 0.5 | 3.2 | 0.5 |
| Blade reverse* (turn-over) | Room temp. | ○ | ○ | ○ | x | ○ | ○*** | ○ |
| | Temp. 40° C./ Humidity 90% RH | ○ | ○ | ○ | x | ○ | x | ○ |
| Cleaning property** (room temperature) | | No failure with 5,000 sheets | No failure with 5,000 sheet | No failure with 5,000 sheets | — | Spotwise failure due to the memory with initial 50 sheets and blank area failure during the prolonged durability | No failure with 5,000 sheets | No failure with 5,000 sheets |

TABLE 1-continued

| | Ex. 1 | Ex. 2 | Ex. 3 | Comp. Ex. 1 | Comp. Ex. 2 | Comp. Ex. 3 | Comp. Ex. 4 |
|---|---|---|---|---|---|---|---|
| | | | | | test | | |

Figure 14:
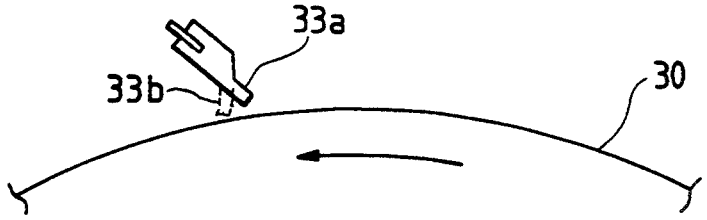
FIG. 14 is a schematic view showing a contact relation of a cleaning blade to an electrostatically charged latent image support.

*In the blade reverse, mark "o" means no occurrence of reversing during the durability test of 5,000 sheets and mark "x" means the occurrence of reversing resulting in the stoppage of the photosensitive member.
**In the cleaning property, "no failure" means that no spotwise image defects/blank area/black lines due to poor cleaning, were observed by visual inspection of copy images.
*Occurrence of abnormal noises The line pressure of cleaning blade on the electrostatically charged latent image support was set to 25 g/cm and the cleaning blade was brought into contact with the electrostatically charged latent image support 30 in a counter direction to the direction of rotation of the support 30, as shown in FIG. 14. Turn-over of the cleaning blade means reversing of the blade tip end from the position 33***a* to the position 33*b* as shown in FIG. 14. The frictional coefficient was determined by a surface tester (made by Heydon Co.).

As is obvious from the foregoing results, the present cleaning blades of Examples 1 to 4 showed no blade turn-over, and produced good images, no poor images caused by remaining memories on the electrostatically charged latent image support or by the deposition of foreign matters on the contact charger.

The cleaning blade of comparative Example 1 had a high frictional coefficient and suffered from blade reverse. The cleaning blade of comparative Example 2 had no occurrence of blade reverse, but had a remaining electrical memory on the electrostatically charged latent image support, thus suffered from the occurrence of spotwise image failure. Furthermore, image failure of a blank area due to the deposition of foreign matters on the contact charger was observed.

The cleaning blade of comparative Example 3 showed no reversing in the ambient conditions (room temperature: 23° C./humidity: 60%, RH), but caused abnormal noise due to the large friction. Furthermore, reversing was observed in high temperature/high moisture conditions (temperature: 40° C./moisture: 90% RH ).

EXAMPLE 5

Figure 15:
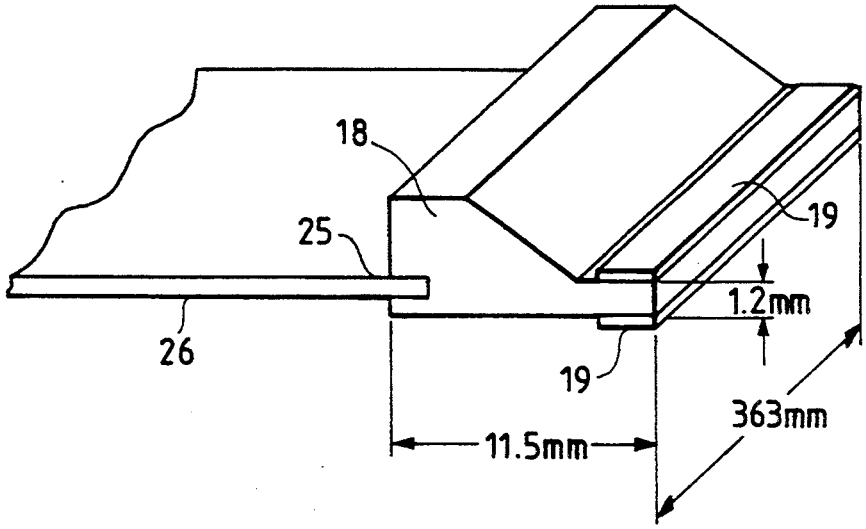
FIG. 15 is a cross-sectional view showing still another embodiment of the present cleaning blade.

A cleaning blade having a shape shown in FIG. 15 was prepared in the same manner as in Example 1, where numeral 26 denotes the support plate metal, 25 denotes the adhesive, 18 denotes the blade body and 19 denotes the coating layer.

EXAMPLE 6

A cleaning blade having a shape shown in FIG. 15 was prepared in the same manner as in Example 1 except that the amount of the polyamide resin (Platamid M995) was changed to 15 parts by weight, that of the graphite fluoride (Cefbon-DM) to 8 parts by weight and the coating layer thickness to 8 μm.

EXAMPLE 7

A cleaning blade having a shape shown in FIG. 15 was prepared in the same manner as in Example 1, except that the amount of the polyamide resin (Platamid M995) was changed to 10 parts by weight, that of the graphite fluoride (Cefbon-DM) to 8 parts by weight, and the coating layer thickness to 5 μm.

EXAMPLE 8

A cleaning blade having a shape shown in FIG. 15 was prepared in the same manner as in Example 1, except that graphite fluoride (Carbon fluoride #2028, trademark of a product made by Asahi Glass K.K.; average particle size: 0.3 μm), was used in place of the graphite fluoride (Cefbon-DM) used in Example 1 and the coating layer thickness was changed to 5 μm.

EXAMPLE 9

A cleaning blade having a shape shown in FIG. 15 was prepared in the same manner as in Example 1, except that the coating layer surface was ground with fixed grinding grains, where aluminum oxide was fixed to the resin surface (Imperial Mark Rapping Film, 60 μm, made by Sumitomo 3M K.K.) to roughen the surface, followed by the cutting.

EXAMPLE 10

A cleaning blade having a shape shown in FIG. 15 was prepared in the same manner as in Example 1, except that the cleaning blade was cut with a heated knife (to 180° C.) having an edge thickness of 0.1 mm in place of the knife shown in FIG. 2.

COMPARATIVE EXAMPLE 4

A cleaning blade having a shape shown in FIG. 15 was prepared in the same manner as in Example 1, except that no lubricating particles were used.

Each cleaning blade prepared in Examples 5 to 10 and Comparative Example 4 was mounted on an electrophotographic copying machine (modified CLC-500, trademark of an apparatus made by Canon, Inc.), using an organic photosensitive member having a photosensitive layer of polycarbonate resin to evaluate the blade-reverse during the initial sliding, blade reverse and abnormal noise during the prolonged durability test up to 5,000 sheets, as well as its cleaning properties. Furthermore, frictional coefficients of the cleaning blades prepared in Examples 5 to 10 and Comparative Example 4 were also determined by a surface tester (made by Heidon Co.). The results are shown in Table 2.

TABLE 2

| | | Ex. 5 | Ex. 6 | Ex. 7 | Ex. 8 | Ex. 9 | Ex. 10 | Comp. Ex. 4 |
|---|---|---|---|---|---|---|---|---|
| Composition of coating agent | Polyamide resin parts by weight | Platamide M995 20 | ← 15 | ← 15 | ← 20 | ← 20 | ← 20 | ← 20 |

TABLE 2-continued

| | | Ex. 5 | Ex. 6 | Ex. 7 | Ex. 8 | Ex. 9 | Ex. 10 | Comp. Ex. 4 |
|---|---|---|---|---|---|---|---|---|
| | Graphite | Cefbon DM | ← | ← | #2028 | Cefbon DM | ← | — |
| | fluoride | 3 | 3 | 3 | 0.3 | 3 | 3 | — |
| | particle size, μm | 4 | 8 | 8 | 4 | 4 | 4 | — |
| | parts by weight | | | | | | | |
| | Methanol parts by weight | 100 | 100 | 100 | 100 | 100 | 100 | 100 |
| Coating layer thickness | μm | 10 | 8 | 5 | 10 | 10 | 10 | 10 |
| Surface roughness of coating layer 1) | μm | 1 | 2 | 3 | 0.7 | 5 | 0.5 | not more than 0.1 |
| Frictional coefficient | | 0.5 | 0.4 | 0.4 | 0.5 | 0.3 | 0.5 | 1.9 |
| Blade reverse 2) (Turn-over) | room temp. | ∘ | ∘ | ∘ | ∘ | ∘ | ∘ | ∘ |
| | 40° C. 90% RH | ∘ | ∘ | ∘ | ∘ | ∘ | ∘ | x |
| Occurrence of abnormal noise | room temp. | ∘ | ∘ | ∘ | ∘ | ∘ | ∘ | x |
| Cleaning property 3) | room temp. | ∘ | ∘ | ∘ | ◎ | ∘ | ◎ | ∘ |
| | 40° C. 90% RH | ∘ | ∘ | ∘ | ∘ | ∘ | ◎ | x |
| Remarks | | | | | | Ground coating surface | Cutting with heated knife (180° C.) | |

Remarks:
1) Contact needle-type surface roughness meter (made by Osaka Kenkyusho)
2) In the blade reverse, mark "∘" means no occurrence of reversing during the durability test of 5,000 sheets and mark "x" means the occurrence of reversing, resulting the stoppage of the photosensitive member.
3) In the cleaning property, mark "∘" means no observation of spotwise image defect/blank area/black lines due to poor cleaning by visual observation of copy images. Mark "◎" means less deposition of toners on the back side of the blade (the side opposite to the sliding direction) after the cleaning durability test in addition to the effect marked by "∘".

As is obvious from the foregoing results, the present cleaning members of Examples 5 to 10 had no occurrence of blade reverse during the initial sliding and showed a good cleaning property.

On the other hand, the cleaning member of Comparative Example 4 had the occurrence of blade reverse (turn-over) in a high temperature/high humidity conditions due to the low surface roughness and also caused the occurrence of abnormal noise at room temperature.

EXAMPLE 11

Blade body

Rubber material

Heat-vulcanizable, silicone rubber (SH746U, trademark of a product made by Toray-Dow Corning Silicone K.K.): 100 parts by weight Curing agent 2,5-dimethyl-2,5-di(tert-butylperoxy)hexane (RC-4: trademark): 0.45 parts by weight Molding conditions Temperature: 170° C.

Time: 15 minutes

Secondary vulcanization conditions

Temperature: 200° C.

Time: 4 hours

Rubber hardness : JIS A 60° C.

Compression set (70° C.): 4%

Modulus: 42 kg/cm

Binder resin

Polyamide resin (CM4000, trademark of a product made by Toray K.K.)

Tensile modulus of elasticity: 5500 kg/cm

Frictional coefficient: 1.9

Attrition loss: 2 mg

Lubricating particles

Graphite fluoride (Cefbon-DM, trademark of a product made by Central Glass K.K.)

Average particle size: 3 μm

Preparation of Cleaning blade

Silicone rubber and the curing agent were dispersed by open rollers and then the dispersion was put into an injection molding machine and injection-molded into a mold provided with a support plate metal pretreated at the part to be connected with the rubber for adhesion, and cured with heating to prepare a blade body of silicone rubber having a predetermined shape.

Separately, 20 parts by weight of polyamide resin (CM4000) was dissolved in 100 parts by weight of methyl alcohol in advance, and 4 parts by weight of graphite fluoride (Cefbon-DM) was uniformly dispersed in the resulting solution. Then, the resulting coating solution was applied to the tip end part of the blade body, air-dried and then dried with heating at 130° C. for 10 minutes to form a coating layer. Then, the blade member was cut into a shape shown in FIG. 15 by an apparatus shown in FIG. 2 to prepare a cleaning blade of the present invention having a coating layer thickness of 10 μm.

EXAMPLE 12

Blade body
Rubber material
Chloroprene rubber (Skyplane B-10, trademark of a product made by Toyo Soda K.K.): 100 parts by weight
Zinc bloom: 5 parts by weight
Magnesium oxide: 4 parts by weight
Carbon: 29 parts by weight
Plasticizer: 1 part by weight
Molding conditions
Temperature: 150° C.
Time: 60 minutes
Rubber hardness: JIS A 60° C.
Compression set (70° C.): 14%
Modulus of elasticity: 40 kg/cm
Binder resin
Polyamide resin (CM4000, trademark of a product made by Toray K.K.)
Tensile modulus of elasticity: 5500 kg/cm
Frictional coefficient: 1.9
Attrition loss: 2 mg
Lubricating particles
Graphite fluoride (Cefbon-DM, trademark of a product made by Central Glass K.K.)
Average particle size: 3 μm
Preparation of Cleaning blade
Chloroprene rubber blended with the additives to the predetermined rubber hardness was heat compression molded in a mold provided with a support plate metal adhesion-pretreated at the part to be connected with the rubber, by a hot press and cured with heating to prepare a blade body of chloroprene having a predetermined shape.

Separately, 20 parts by weight of polyamide resin (CM4000) was dissolved in 100 parts by weight of methyl alcohol, and then 4 parts by weight of graphite fluoride (Cefbon-DM) was uniformly dispersed in the resulting solution. Then, the resulting coating solution was applied to the tip end part of the blade body by dipping, air-dried and then dried with heating at 130° C. for 10 minutes to form a coating layer. Then, the blade member was cut into a shape shown in FIG. 15 by an apparatus shown in FIG. 2 to prepare a cleaning blade of the present invention having a coating layer thickness of about 10 μm.

COMPARATIVE EXAMPLE: EXAMPLE 13

Blade body
Rubber material
Ethylene adipate-based urethane prepolymer (made by Nihon Polyurethane Kogyo K.K.): 100 parts by weight
Number average molecular weight (Mn): 1500
Isocyanate content (NCO): 6.2 wt.%
Curing agent
1,4-butanediol: 3.9 parts by weight
Trimethylolpropane: 2.1 parts by weight
Molding conditions
Temperature: 130° C.
Time: 30 minutes
Secondary vulcanization conditions
Temperature: 130° C.
Time: 4 hours
Rubber hardness: JIS A 62° C.
Compression set (70° C.): 9 %
Modulus: 45 kg/cm
Binder resin
Fluorocarbon resin (NGM#2800-2, trademark of a product made by Toa Paint K.K.)
Tensile modulus of elasticity: 13,000 kg/cm
Frictional coefficient: 0.8
Attrition loss: 32 mg
Lubricating particles
Graphite fluoride (Cefbon-DM, trademark of a product made by Central Glass K.K.)
Average particle size: 3 μm
Preparation of Cleaning blade
Heat molten urethane prepolymer was mixed with a curing agent and the mixture was poured into a mold provided with a support plate metal pretreated for adhesion at the part to be connected with rubber, and cured with heating to prepare a blade body of urethane rubber having a predetermined shape.

Separately, 20 parts by weight of polyvinyl alcohol fluoride (NGM#2800-2) was dissolved in 100 parts by weight of toluene in advance and then 4 parts by weight of graphite fluoride (Cefbon-DM) was uniformly dispersed in the resulting solution. The resulting coating solution was applied to the tip end part of the blade body by dipping, dried spontaneously and then dried with heating at 130° C. for one hour to form a coating layer. The blade member was cut into a shape shown in FIG. 15 by an apparatus shown in FIG. 2 to prepare a cleaning blade of the present invention having a coating layer thickness of 10 μm.

COMPARATIVE EXAMPLE: EXAMPLE 14

Blade body
Rubber material
Ethylene adipate-based urethane prepolymer (made by Nihon Polyurethane Kogyo K.K.): 100 parts by weight
Number average molecular weight (Mn): 1500
Isocyanate content (NCO): 6.2 wt. %
Curing agent
1,4-butanediol: 3.9 parts by weight
Trimethylolpropane: 2.1 parts by weight
Molding conditions
Temperature: 130° C.
Time: 30 minutes
Secondary vulcanization conditions
Temperature: 130° C.
Time: 4 hours
Rubber hardness: JIS A 62° C.
Compression set (70° C.): 9 %
Modulus of elasticity: 45 kg/cm
Binder resin
Fluorocarbon rubber resin (Eight Seal F20UT, trademark of a product made by Asahi Glass K.K.)
Tensile modulus of elasticity: 30 kg/cm
Frictional coefficient: 3.2
Attrition loss: 18 mg
Lubricating particles
Graphite fluoride (Cefbon-DM, trademark of a product made by Central Glass K.K.)
Average particle size: 3 μm
Preparation of Cleaning blade
Heat molten urethane prepolymer was mixed with curing agents and the mixture was poured into a mold provided with a support plate metal with an adhesion-pretreated connection part with rubber and cured with heating to prepare a blade body of urethane rubber having a predetermined shape.

Separately, 20 parts by weight of vinylidene-based fluororubber (Eight Seal F20UT) in terms of binder solid matters was dissolved in 100 parts by weight of methylisobutylketone in advance, and then 4 parts by weight of graphite fluoride (Cefbon-DM) was uniformly dispersed in the resulting solution.

The resulting coating solution was applied to the tip end part of the blade body by dipping, dried spontaneously and then dried with heating at 130° C. for one hour to form a coating layer. Then, the blade member was cut into a shape shown in FIG. 15 by an apparatus shown in FIG. 2 to prepare a cleaning blade of the present invention having a coating layer thickness of 10 μm.

EXAMPLE 15

Blade body
- Rubber material
- Ethylene adipate-based urethane prepolymer (made by Nihon Polyurethane Kogyo K.K.): 100 parts by weight
- Number average molecular weight (Mn): 1500
- Isocyanate content (NCO): 6.2 wt.%
- Curing agent
- 1,4-butanediol: 3.9 parts by weight
- Trimethylolpropane: 2.1 parts by weight
- Molding conditions
- Temperature: 130° C.
- Time: 30 minutes
- Secondary vulcanization condition
- Temperature: 130° C.
- Time: 4 hours
- Rubber hardness: JIS A 62° C.
- Compression set (70° C.): 9%
- Modulus of elasticity: 45 kg/cm Binder resin
- Polyamide resin (CM4000, trademark of a product made of Toray K.K.)
- Tensile modulus of elasticity: 5500 kg/cm
- Frictional coefficient: 1.9
- Attrition loss: 2 mg Lubricating particles
- Silicone graphite (Tospal, trademark of a product made by Toshiba Silicone K.K.)
- Average particle size: 4 μm Preparation of Cleaning blade Heat molten urethane prepolymer was mixed with curing agents and the mixture was poured into a mold provided with a support plate metal with an adhesion-pretreated connection part with rubber and cured with heating to prepare a blade body of urethane rubber having a predetermined shape.

Separately, 20 parts by weight of polyamide resin (CM4000) was dissolved in 100 parts by weight of methyl alcohol in advance and then 4 parts by weight of silicone resin particles (Tospal) was uniformly dispersed in the resulting solution. The resulting coating solution was applied to the tip end part of the blade body by dipping, dried spontaneously and then dried with heating at 130° C. for 10 minutes to form a coating layer. The blade member was cut into a shape shown in FIG. 15 by an apparatus shown in FIG. 2 to prepare a cleaning blade of the present invention having a coating layer thickness of 10 μm.

EXAMPLE 16

Blade body
- Rubber material
- Ethylene adipate-based urethane prepolymer (made by Nihon Polyurethane Kogyo K.K.): 100 parts by weight
- Number average molecular weight (Mn): 1500
- Isocyanate content (NCO): 6.2 wt. %
- Curing agent
- 1,4-butanediol: 3.9 parts by weight
- Trimethylolpropane: 2.1 parts by weight
- Molding conditions
- Temperature: 130° C.
- Time: 30 minutes
- Secondary vulcanization conditions
- Temperature: 130° C.
- Time: 4 hours
- Rubber hardness: JIS A 62° C.
- Compression set (70° C.): 9%
- Modulus of elasticity: 45 kg/cm Binder resin
- Polyamide resin (CM4000, trademark of a product made by Toray K.K.)
- Tensile modulus of elasticity: 5500 kg/cm
- Frictional coefficient: 1.9
- Attrition loss: 2 mg Lubricating particles
- Polyamide resin (SNP-609, trademark of a product made by Metal Color Co.)
- Average particle size: 6 μm Preparation of Cleaning blade Heat molten urethane prepolymer was mixed with curing agents and the mixture was poured into a mold provided with a support plate metal with an adhesion-pretreated connection part with rubber and cured with heating to prepare a blade body of urethane rubber having a predetermined shape.

Separately, 20 parts by weight of polyamide resin (CM4000) was dissolved in 100 parts by weight of methyl alcohol in advance, and then 4 parts by weight of polyamide resin particles (SNP-609) was uniformly dispersed in the resulting solution. The resulting coating solution was applied to the tip end part of the blade body by dipping, dried spontaneously and then dried with heating at 130° C. for 10 minutes to form a coating layer. The blade member was cut into a shape shown in FIG. 15 by an apparatus shown in FIG. 2 to prepare a cleaning blade of the present invention having a coating layer thickness of 10 μm.

EXAMPLE 17

Blade body
- Rubber material
- Ethylene adipate-based urethane prepolymer made by Nihon Polyurethane Kogyo K.K.): 100 parts by weight
- Number average molecular weight (Mn): 1500
- Isocyanate content (NCO): 6.2 wt. %
- Curing agent
- 1,4-butanediol: 3.9 parts by weight
- Trimethylolpropane: 2.1 parts by weight
- Molding conditions
- Temperature: 130° C.
- Time: 30 minutes
- Secondary vulcanization conditions
- Temperature: 130° C.
- Time: 4 hours Rubber hardness: JIS A 62° C.

Compression set (70° C.): 9%

Modulus of elasticity: 45 kg/cm

Binder resin

Polyamide resin (CM4000, trademark of a product made by Toray K.K.)

Tensile modulus of elasticity: 5500 kg/cm

Frictional coefficient: 1.9

Attrition loss: 2 mg

Lubricating particles

Graphite fluoride (Cefbon-DM, trademark of a product made by Central Glass K.K.)

Average particle size: 3 μm

Preparation of Cleaning blade

Heat molten urethane prepolymer was mixed with curing agents and the mixture was poured into a mold provided with a support plate metal with an adhesion-pretreated connection part with rubber, curved with heating to prepare a blade body having a predetermined shape.

Separately, 20 parts by weight of polyamide resin (CM4000) was dissolved in 100 parts by weight of methyl alcohol in advance, and then 4 parts by weight of graphite fluoride (Cefbon-DM) was uniformly dispersed in the resulting solution. The resulting coating solution was applied to the tip end part of the blade body by dipping, dried spontaneously and then dried with heating at 130° C. for 10 minutes to form a coating layer. The blade member was cut into a shape shown in FIG. 15 by an apparatus shown in FIG. 2 to prepare a cleaning blade of the present invention having a coating layer thickness of 10 μm.

The cleaning blades prepared in Examples 11 to 17 were evaluated in the same manner as in Examples 5 to 10 and Comparative Example 4, except that the durability test was conducted up to 7,000 sheets. The results are shown in Table 3.

TABLE 3

| | | | Ex. 11 | Ex. 12 | Ex. 13 | Ex. 14 | Ex. 15 | Ex. 16 | Ex. 17 |
|---|---|---|---|---|---|---|---|---|---|
| Blade body | | | Silicone rubber | Chloroprene rubber | Urethane rubber | | | | |
| Composition of coating agent | Binder resin parts by weight | | Polyamide CM4000 20 | 20 | Fluorocarbon resin NGM #2800-2 20 | Fluoro rubber (Eight Seal F2OUT) 20 | Polyamide CM4000 20 | 20 | 20 |
| | Lubricability particle size μm parts by weight | | Graphite fluoride Cefbon-DM 3 4 | 3 4 | 3 4 | 3 4 | Silicone resin Tospar1 4 4 | Polyamide resin SNP-609 6 4 | Graphite fluoride Cefbon-DM 3 4 |
| | Solvent parts by weight | | Methanol 100 | 100 | Toluene 100 | Methyl-isobutyl-ketone 100 | Methanol 100 | Methanol 100 | Methanol 100 |
| Coating layer thickness | μm | | 10 | 10 | 10 | 10 | 10 | 10 | 10 |
| Coating layer surface roughness 1) | μm | | 1 | 1 | 1 | 1 | 1.5 | 5 | 1 |
| Frictional coefficient | μ | | 0.5 | 0.5 | 0.4 | 1.3 | 0.6 | 1.0 | 0.5 |
| Blade reverse 2) (Turn-over) | room temp. 23° C. 60% RH | | ○ | ○ | ○ | Δ | ○ | ◎ | ◎ |
| | 40° C. 90% RH | | ○ | ○ | Δ | Δ | ○ | ○ | ◎ |
| Occurrence of abnormal noise | room temp. 23° C. 60% RH | | ○ | ○ | ○ | ○ | ○ | ○ | ○ |
| Cleaning property 3) | 3,000 sheets | room temp. 23° C. 60% RH | ○ | ○ | ○ | ○ | ○ | ○ | ○ |
| | | 40° C. 90% RH | ○ | ○ | ○ | ○ | ○ | ○ | ○ |
| | 5,000 sheets | room temp. 23° C. 60% RH | ○ | ○ | ○ | x | ○ | ○ | ○ |
| | | 40° C. 90% RH | ○ | ○ | x | x | ○ | x | ○ |
| | 7,000 sheets | room temp. 23° C. 60% RH | x | Δ | x | — | x | ○ | ○ |
| | | 40° C. 90% RH | x | Δ | — | — | x | — | ○ |
| Remarks | | | Coating layer | Coating layer | Coating layer | Coating layer | Coating layer | Coating layer | |

TABLE 3-continued

| | Ex. 11 | Ex. 12 | Ex. 13 | Ex. 14 | Ex. 15 | Ex. 16 | Ex. 17 |
|---|---|---|---|---|---|---|---|
| | peeled | peeled | worn | worn | worn | worn | |

Remarks:
1) Contact needle type, surface roughness meter (Osaka Kenkyusho)
2) In the blade reverse, mark "x" means the occurrence of reversal in the durability test of 3,000 sheets, mark "Δ" means the occurrence of reversal during the durability test of 3,000 to 5,000 sheets, mark "o" means the occurrence of reversal during the durability test of 5,000 to 7,000 sheets and mark "◎" means no occurrence of reversal during the durability test of 7,000 sheets.
3) In the cleaning property, mark "o" means no observation of spotwise image defect/blank area/black lines due to cleaning failure by visual observation of copy images, and mark "Δ" means no observation of spotwise image defect/blank area/black lines due to poor cleaning until the occurrence of reversal by visual observation of copy images.

What is claimed is:

1. A cleaning blade for press contacting a surface of an electrostatically charged latent image support to remove toner remaining on the surface, said cleaning blade comprising an elongated blade body having a rubber elasticity and a coating layer, said coating layer covering at least a contacting portion of the blade body for press contacting the surface of the latent image support, said contacting portion extending substantially parallel to an axis of the latent image support, wherein said coating layer comprises lubricating particles and a binder resin, said binder resin having a tensile modulus of elasticity of $10^4$ kg/cm$^2$ or less and an attrition loss of 0.1 to 10 mg.

2. The cleaning blade for electrophotography according to claim 1, wherein said blade body has a modulus of elasticity of 10 to 10 kg/cm$^2$.

3. The cleaning blade for electrophotography according to claim 1, wherein said blade body has a modulus of elasticity of 20 to 100 kg/cm$^2$.

4. The cleaning blade for electrophotography according to claim 1, wherein said blade body has a compression set of not more than 20%.

5. The cleaning blade for electrophotography according to claim 1, wherein said blade body has a compression set of 1 to 10%.

6. The cleaning blade for electrophotography according to claim 1, wherein said blade body comprises a material selected from the group consisting of urethane rubber, silicone rubber, nitrile rubber and chloroprene rubber.

7. The cleaning blade for electrophotography according to claim 1, wherein said blade body comprises urethane rubber.

8. The cleaning blade for electrophotography according to claim 7, wherein said urethane rubber comprises a two-pot type, thermo-settable polyurethane rubber.

9. The cleaning blade for electrophotography according to claim 1, wherein said blade body has a hardness of 40° to 90°.

10. The cleaning blade for electrophotography according to claim 1, wherein said blade body has a hardness of 50° to 80°.

11. The cleaning blade for electrophotography according to claim 1, wherein said binder resin has a tensile modulus of elasticity of 10 to $10^5$ kg/cm$^2$.

12. The cleaning blade for electrophotography according to claim 1, wherein said binder resin has a tensile modulus of elasticity of $10^2$ to $10^4$ kg/cm$^2$.

13. The cleaning blade for electrophotography according to claim 1, wherein said binder resin comprises polyamide resin.

14. The cleaning blade for electrophotography according to claim 1, wherein said binder resin comprises a cross-linked polyamide resin.

15. The cleaning blade for electrophotography according to claim 14, wherein said cross-linked polyamide resin is self-cross-linkable.

16. The cleaning blade for electrophotography according to claim 14, wherein said cross-linked polyamide resin contains a cross-linking agent.

17. The cleaning blade for electrophotography according to claim 1, wherein said lubricating particles comprise a solid lubricating agent.

18. The cleaning blade for electrophotography according to claim 1, wherein said lubricating particles comprise a material selected from the group consisting of graphite fluoride, fluorocarbon resin, silicone resin and polyamide resin.

19. The cleaning blade for electrophotography according to claim 1, wherein said lubricating particles are in an irregular shape.

20. The cleaning blade for electrophotography according to claim 1, wherein said lubricating particles comprise graphite fluoride.

21. The cleaning blade for electrophotography according to claim 1, wherein said lubricating particles have an average particle size of 0.1 to 5 μm.

22. The cleaning blade for electrophotography according to claim 1, wherein said lubricating particles are in an amount of 5 to 50 parts by weight on the basis of 100 parts by weight of the binder resin.

23. The cleaning blade for electrophotography according to claim 1, wherein said coating layer contains the lubricating particles dispersed in the binder resin.

24. The cleaning blade for electrophotography according to claim 1, wherein said coating layer has a surface roughness of 0.05 to 5 μm.

25. The cleaning blade for electrophotography according to claim 1, wherein said coating layer has a thickness of 1 to 100 μm.

26. The cleaning blade for electrophotography according to claim 1, wherein said coating layer has a thickness of 5 to 30 μm.

27. The cleaning blade for electrophotography according to claim 1, wherein said coating layer is formed on the surface of the blade body by application of a solution mixture comprising the binder resin, the lubricating particles and a solvent selected from the group consisting of an alcoholic solvent, a chlorinic solvent, a ketonic solvent, an esteral solvent, and their mixtures, and water.

28. The cleaning blade for electrophotography according to claim 1, wherein said coating layer has a frictional coefficient of 0.01 to 1.5.

29. The cleaning blade for electrophotography according to claim 1, wherein said coating layer has a frictional coefficient of 0.1 to 0.6.

30. A cleaning device for electrophotography, comprising a cleaning blade for press contacting a surface of an electrostatically charged latent image support to remove toner remaining on the surface, said cleaning blade comprising an elongated blade body having a rubbery elasticity and a coating layer, said coating layer covering at least a contacting portion of said elongated blade body for press contacting the surface of the latent image support, said contacting portion extending substantially parallel to an axis of the latent image support, wherein said coating layer comprises lubricating particles and a binder resin, said binder resin having a tensile modulus of elasticity of $10^4$ kg/cm$^2$ or less and an attrition loss of 0.1 to 10 $\mu$g.

31. The cleaning device for electrophotography according to claim 30, wherein said coating layer has a frictional coefficient of 0.1 to 0.6.

32. The cleaning device for electrophotography according to claim 30, wherein said cleaning blade has a coating layer comprising graphite fluoride and polyamide resin on the surface of the blade body of polyurethane resin.

33. An apparatus unit which is detachable from an apparatus body, comprising:

an electrostatically charged latent image support for supporting electrostatically charged latent images; and cleaning means comprising a cleaning blade for press contacting a surface of said electrostatically charged latent image support to remove toner remaining on the surface, wherein said cleaning blade comprises an elongated blade body having a rubbery elasticity and a coating layer, said coating layer covering at least a contacting portion of the blade body for press contacting the surface of the latent image support, said contacting portion extending substantially parallel to an axis of the latent image support, and wherein said coating layer comprises lubricating particles and a binder resin, said binder resin having a tensile modulus of elasticity of $10^4$ kg/cm$^2$ or less and an attrition loss of 0.1 to 10 mg.

34. The apparatus unit according to claim 33, wherein said coating layer has a frictional coefficient of 0.1 to 0.6.

35. The apparatus unit according to claim 33, wherein said cleaning blade has the coating layer comprising graphite fluoride and polyamide resin on the surface of the blade body of polyurethane resin.

36. An electrophotographic apparatus comprising:

an electrostatically charged latent image support for supporting electrostatically charged latent images;

charging means for charging said electrostatically charged latent image support;

latent image-forming means for forming electrostatically charged latent images on the electrostatically charged latent image support;

developing means for developing electrostatically charged latent images supported on said electrostatically charged latent image support; and cleaning means comprising a cleaning blade for press contacting a surface of said electrostatically charged latent image support to remove toner remaining on the surface, wherein said cleaning blade comprises an elongated blade body having a rubbery elasticity and a coating layer, said coating layer covering at least a contact surface of the blade body for press contacting the surface of the latent image support, said contact surface extending substantially parallel to an axis of the latent image support, said coating layer comprising lubricating particles and a binder resin, said binder resin having a tensile modulus of elasticity of $10^4$ kg /cm$^2$ or less and an attrition loss of 0.1 to 10 mg.

37. The electrophotographic apparatus according to claim 36, wherein said coating layer has a frictional coefficient of 0.1 to 0.6.

38. The electrophotographic apparatus according to claim 36, wherein said cleaning blade has the coating layer comprising graphite fluoride and polyamide resin on the surface of the blade body of polyurethane resin.

39. A facsimile apparatus comprising:

an electrophotographic apparatus; and receiving means for receiving image information from a remote terminal, wherein said electrophotographic apparatus comprises:

an electrostatically charged latent image support for supporting electrostatically charged latent images;

charging means for charging said electrostatically charged latent image support;

latent image-forming means for forming electrostatically charged latent images on said electrostatically charged latent image support;

developing means for developing the electrostatically charged latent images supported on said electrostatically charged latent image support; and cleaning means comprising a cleaning blade for press contacting a surface of said electrostatically charged latent image support to remove toner remaining on the surface, wherein said cleaning blade comprises an elongated blade body having a rubbery elasticity and a coating layer, said coating layer covering at least a contact surface of the blade body for press contacting the surface of the latent image support, said contact surface extending substantially parallel to an axis of the latent image support, said coating layer comprising lubricating particles and a binder resin, said binder resin having a tensile modulus of elasticity of $10^4$ kg/cm$^2$ or less and an attrition loss of 0.1 to 10 mg.

40. The facsimile apparatus according to claim 39, wherein said coating layer has a frictional coefficient of 0.1 to 0.6.

41. The facsimile apparatus according to claim 39, wherein said cleaning blade has the coating layer comprising graphite fluoride and polyamide resin on the surface of the blade body of polyurethane resin.

42. The cleaning blade for electrophotography according to claim 1, wherein said blade body comprises urethane rubber and said coating layer comprises lubricating particles comprising graphite fluoride and a binder resin comprising a polyamide resin.

43. The cleaning device for electrophotography according to claim 30, wherein said blade body comprises urethane rubber and said coating layer comprises lubricating particles comprising graphite fluoride and a binder resin comprising a polyamide resin.

44. The apparatus unit according to claim 33, wherein said blade body comprises urethane rubber and said coating layer comprises lubricating particles comprising graphite fluoride and a binder resin comprising a polyamide resin.

45. The electrophotographic apparatus according to claim 36, wherein said blade body comprises urethane rubber and said coating layer comprises lubricating particles comprising graphite fluoride and a binder resin comprising a polyamide resin.

46. The facsimile apparatus according to claim 39, wherein said blade body comprises urethane rubber and said coating layer comprises lubricating particles comprising graphite fluoride and a binder resin comprising a polyamide resin.

47. The cleaning blade comprising claim 1, wherein the lubricating particles protrude from the binder resin on the contacting portion of the coating layer.

48. The cleaning blade for electrophotography according to claim 47, wherein said coating layer has a net frictional coefficient of 0.1 to 0.6.

49. The cleaning blade for electrophotography according to claim 47, wherein said coating layer comprises graphite fluoride and polyamide resin and the surface of the blade body comprises polyurethane resin.

50. The cleaning blade for electrophotography according to claim 47, wherein said blade body comprises urethane rubber and said coating layer comprises lubricating particles comprising graphite fluoride and a binder resin comprising a polyamide resin.

51. The cleaning device comprising claim 30, wherein the lubricating particles protrude from the binder resin on the contacting portion of the coating layer.

52. The cleaning device for electrophotography according to claim 51, wherein said coating layer has a net frictional coefficient of 0.1 to 0.6.

53. The cleaning device for electrophotography according to claim 51, wherein said coating layer comprises graphite fluoride and polyamide resin and the surface of the blade body comprises polyurethane resin.

54. The cleaning device for electrophotography according to claim 51, wherein said blade body comprises urethane rubber and said coating layer comprises lubricating particles comprising graphite fluoride and a binder resin comprising a polyamide resin.

55. The apparatus unit according to claim 33, wherein the lubricating particles protrude from the binder resin on the contacting portion of the coating layer.

56. The apparatus unit according to claim 55, wherein said coating layer has a net frictional coefficient of 0.1 to 0.6.

57. The apparatus unit according to claim 55, wherein said coating layer comprises graphite fluoride and polyamide resin and the surface of the blade body comprises polyurethane resin.

58. The apparatus unit according to claim 55, wherein said body comprises urethane rubber and said coating layer comprises lubricating particles comprising graphite fluoride and a binder resin comprising a polyamide resin.

59. The electrophotographic apparatus according to claim 36, wherein the lubricating particles protrude from the binder resin on the contact surface of the coating layer.

60. The electrophotographic apparatus according to claim 59, wherein said coating layer has a net frictional coefficient of 0.1 to 0.6.

61. The electrophotographic apparatus according to claim 59, wherein said coating layer comprises graphite fluoride and polyamide resin and the surface of the blade body comprises polyurethane resin.

62. The electrophotographic apparatus according to claim 59, wherein said blade body comprises urethane rubber and said coating layer comprises lubricating particles comprising graphite fluoride and a binder resin comprising a polyamide resin.

63. The facsimile apparatus according to claim 39, wherein the lubricating particles protrude from the binder resin on the contacting portion of the coating layer.

64. The facsimile apparatus according to claim 63, wherein said coating layer has a net frictional coefficient of 0.1 to 0.6.

65. The facsimile apparatus according to claim 63, wherein said coating layer comprises graphite fluoride and polyamide resin and the surface of the blade body comprises polyurethane resin.

66. The facsimile apparatus according to claim 63, wherein said blade body comprises urethane rubber and said coating layer comprises lubricating particles comprising graphite fluoride and a binder resin comprising a polyamide resin.

67. A cleaning blade for press contacting a surface of an electrostatically charged latent image support to remove toner remaining on the surface, said cleaning blade comprising an elongated blade body having a rubbery elasticity and a coating layer, said coating layer covering at least a contacting portion of the blade body for press contacting the surface of the electrostatically charged latent image support, said contacting portion extending substantially parallel to an axis of the latent image support, wherein said coating layer comprises lubricating particles and a binder resin comprising a polyamide resin.

68. A cleaning device for electrophotography, comprising a cleaning blade for press contacting a surface of an electrostatically charged latent image support to remove toner remaining on the surface, said cleaning blade comprising an elongated blade body having a rubbery elasticity and a coating layer, said coating layer covering at least a contacting portion of the blade body for press contacting the surface of the latent image support, said contacting portion extending substantially parallel to an axis of the latent image support, wherein said coating layer comprises lubricating particles and a binder resin, said binder resin comprising a polyamide resin.

69. An apparatus unit which is detachable from an apparatus body, comprising:

an electrostatically charged latent image support for supporting electrostatically charged latent images; and cleaning means comprising a cleaning blade for press contacting a surface of said electrostatically charged latent image support to remove toner remaining on the surface, wherein said cleaning blade comprises an elongated blade body having a rubbery elasticity and a coating layer, said coating layer covering at least a contacting portion of the blade body for press contacting the surface of the latent image support, said contacting portion extending substantially parallel to an axis of the latent image support, and wherein said coating layer comprises lubricating particles and a binder resin, said binder resin comprising a polyamide resin.

70. An electrophotographic apparatus comprising:

an electrostatically charged latent image support for supporting electrostatically charged latent images;

charging means for charging said electrostatically charged latent image support;

latent image-forming means for forming electrostatically charged latent images on the electrostatically charged latent image support;

developing means for developing electrostatically charged latent images supported on said electrostatically charged latent image support; and cleaning means comprising a cleaning blade for press contacting a surface of said electrostatically charged latent image support to remove toner remaining on the surface, wherein said cleaning blade comprises an elongated blade body having a rubbery elasticity and a coating layer, said coating layer covering at least a contact surface of the blade body for press contacting the surface of the latent image support, said contact surface extending substantially parallel to an axis of the latent image support, said coating layer comprising lubricating particles and a binder resin, said binder resin comprising a polyamide resin, and wherein the lubricating particles are directly exposed from the binder resin on the contact surface of the coating layer with said electrostatically charged latent image support.

71. A facsimile apparatus comprising:

an electrophotographic apparatus; and receiving means for receiving image information from a remote terminal;

wherein said electrophotographic apparatus comprises:

an electrostatically charged latent image support for supporting electrostatically charged latent images;

charging means for charging said electrostatically charged latent image support;

latent image-forming means for forming electrostatically charged latent images on said electrostatically charged latent image support;

developing means for developing the electrostatically charged latent images supported on said electrostatically charged latent image support; and cleaning means comprising a cleaning blade for press contacting a surface of the electrostatically charged latent image support to remove toner remaining on the surface, wherein said cleaning blade comprises an elongated blade body having a rubbery elasticity and a coating layer, said coating layer covering at least a contact surface of the blade body for press contacting the surface of the latent image support, said contact surface extending substantially parallel to an axis of the latent image support, said coating layer comprising lubricating particles and a binder resin, said binder resin comprising a polyamide resin.

72. The cleaning blade for electrophotography according to claim 1, wherein said binder resin has a tensile modulus of elasticity of 10 to $10^4$ kg/cm$^2$.

73. The cleaning blade for electrophotography according to claim 1, wherein said binder resin has a frictional coefficient of 0.5 to 2.5.

74. The cleaning blade for electrophotography according to claim 47, wherein said binder resin has a tensile modulus of elasticity of 10 to $10^4$ kg/cm$^2$.

75. The cleaning blade for electrophotography according to claim 47, wherein said binder resin has a tensile modulus of elasticity of $10^2$ to $10^4$ kg/cm$^2$.

76. The cleaning device for electrophotography according to claim 30, wherein said binder resin has a tensile modulus of elasticity of 10 to $10^4$ kg/cm$^2$.

77. The cleaning device for electrophotography according to claim 30, wherein said binder resin has a tensile modulus of elasticity of $10^2$ to $10^4$ kg/cm$^2$.

78. The cleaning device for electrophotography according to claim 30, wherein said binder resin has a frictional coefficient of 0.5 to 2.5.

79. The cleaning device for electrophotography according to claim 51, wherein said binder resin has a tensile modulus of elasticity of 10 to $10^4$ kg/cm$^2$.

80. The cleaning device for electrophotography according to claim 51, wherein said binder resin has a tensile modulus of elasticity of $10^2$ to $10^4$ kg/cm$^2$.

81. The apparatus unit according to claim 33, wherein said binder resin has a tensile modulus of elasticity of 10 to $10^4$ kg/cm$^2$.

82. The apparatus unit according to claim 33, wherein said binder resin has a tensile modulus of elasticity of $10^2$ to $10^4$ kg/cm$^2$.

83. The apparatus unit according to claim 33, wherein said binder resin has a frictional coefficient of 0.5 to 2.5.

84. The apparatus unit according to claim 55, wherein said binder resin has a tensile modulus of elasticity of 10 to $10^4$ kg/cm$^2$.

85. The apparatus unit according to claim 55, wherein said binder resin has a tensile modulus of elasticity of $10^2$ to $10^4$ kg/cm$^2$.

86. The electrophotographic apparatus according to claim 33, wherein said binder resin has a tensile modulus of elasticity of 10 to $10^4$ kg/cm$^2$.

87. The electrophotographic apparatus according to claim 33, wherein said binder resin has a tensile modulus of elasticity of $10^2$ to $10^4$ kg/cm$^2$.

88. The electrophotographic apparatus according to claim 33, wherein said binder resin has a frictional coefficient of 0.5 to 2.5.

89. The electrophotographic apparatus according to claim 55, wherein said binder resin has a tensile modulus of elasticity of 10 to $10^4$ kg/cm$^2$.

90. The electrophotographic apparatus according to claim 55, wherein said binder resin has a tensile modulus of elasticity of $10^2$ to $10^4$ kg/cm$^2$.

91. The facsimile apparatus according to claim 34, wherein said binder resin has a tensile modulus of elasticity of 10 to $10^4$ kg/cm$^2$.

92. The facsimile apparatus according to claim 39, wherein said binder resin has a tensile modulus of elasticity of $10^2$ to $10^4$ kg/cm$^2$.

93. The facsimile apparatus according to claim 39, wherein said binder resin has a frictional coefficient of 0.5 to 2.5.

94. The facsimile apparatus according to claim 63, wherein said binder resin has tensile modulus of elasticity of 10 to $10^4$ kg/cm$^2$.

95. The facsimile apparatus according to claim 63, wherein said binder resin has a tensile modulus of elasticity of $10^2$ to $10^4$ kg/cm$^2$.

* * * * *

UNITED STATES PATENT AND TRADEMARK OFFICE

CERTIFICATE OF CORRECTION

PATENT NO. : 5,450,184 Page 1 of 4

DATED : September 12, 1995

INVENTOR(S) : Noriyuki YANAI, et al.

It is certified that error appears in the above-indentified patent and that said Letters Patent is hereby corrected as shown below:

COLUMN 1:

Line 27, "below," should read --below:--;
Line 33, "member," should read --member.--.

COLUMN 3:

Line 17, "no or less" should read --little or no--.
Line 50, "good" should read --a--;
Line 51, "a" should read --good--.

COLUMN 7:

Line 12, "FIG. 12" should begin a new paragraph;
Line 47, "hexafuoride" should read --nexafluoride--;
Line 54, "is" should read --are--;
Line 63, "compose" should read --composed-- and "their" should read --its--;
Line 66, "Japan)" should read --Japan);--;
Line 67, a;" should read --a--.

UNITED STATES PATENT AND TRADEMARK OFFICE

CERTIFICATE OF CORRECTION

PATENT NO. : 5,450,184 Page 2 of 4

DATED : September 12, 1995

INVENTOR(S) : Noriyuki YANAI, et al.

It is certified that error appears in the above-indentified patent and that said Letters Patent is hereby corrected as shown below:

COLUMN 8:

Line 15, "reisn" should read --resin--;
Line 17, "to not" should read --not to--.

COLUMN 9:

Line 14, "solvents," (both occurrences) should read --solvent,-- and "solvents" should read --solvent--;
Line 59, "component." should read --components.--.

COLUMN 10:

Line 54, "recepter" should read --receptor--.

COLUMN 13:

Line 66, "surfaced," should read --surface,--.

COLUMN 15:

Line 39, "is" should be deleted;
Line 40, "not limited the present invention." should read --the present invention is not limited.--.

UNITED STATES PATENT AND TRADEMARK OFFICE

CERTIFICATE OF CORRECTION

PATENT NO. : 5,450,184 Page 3 of 4

DATED : September 12, 1995

INVENTOR(S) : Noriyuki YANAI, et al.

It is certified that error appears in the above-indentified patent and that said Letters Patent is hereby corrected as shown below:

COLUMN 16:

Line 5, "uretahne" should read --urethane--.

COLUMN 20:

Table 1, "sheet" should read --sheets--.

COLUMN 21:

Line 38, "the" should be deleted.

COLUMN 22:

Table 2, "Platamide" should read --Platamid--.

COLUMN 30:

Line 18, "up" should read --for up--.

COLUMN 31:

Line 19, "rubber" should read --rubbery--;
Line 30, "10 $kg/cm^2$" should read --$10^3$ $kg/cm^2$.--.

UNITED STATES PATENT AND TRADEMARK OFFICE

CERTIFICATE OF CORRECTION

PATENT NO. : 5,450,184 Page 4 of 4

DATED : September 12, 1995

INVENTOR(S) : Noriyuki YANAI, et al.

It is certified that error appears in the above-indentified patent and that said Letters Patent is hereby corrected as shown below:

COLUMN 33:

Line 10, "10 μg." should read --10 mg.--.

COLUMN 38:

Line 48, "claim 34," should read --claim 39,--.

Signed and Sealed this

Fifth Day of March, 1996

Bruce Lehman

*Attest:*

BRUCE LEHMAN

*Attesting Officer*

*Commissioner of Patents and Trademarks*